United States Patent [19]

Gast

[11] Patent Number: 4,901,431

[45] Date of Patent: Feb. 20, 1990

[54] POWERED FASTENER INSTALLATION APPARATUS

[75] Inventor: Robert L. Gast, Tustin, Calif.

[73] Assignee: Textron Inc., Providence, R.I.

[21] Appl. No.: 203,240

[22] Filed: Jun. 6, 1988

[51] Int. Cl.[4] ..... B21J 15/28

[52] U.S. Cl. ..... 29/707; 29/709; 227/1; 227/2

[58] Field of Search ..... 29/407, 707, 710, 709; 227/1, 2, 53, 55

[56] References Cited

U.S. PATENT DOCUMENTS

| | | | |
|---|---|---|---|
| 2,943,335 | 7/1960 | Daniel et al. | 29/710 X |
| 3,932,931 | 1/1976 | Wright | 29/707 X |
| 4,027,520 | 6/1977 | Klein . | |
| 4,062,216 | 12/1977 | Ebbert et al. . | |
| 4,178,669 | 12/1979 | Hara et al. . | |
| 4,180,195 | 12/1979 | Caley et al. . | |
| 4,275,583 | 6/1981 | Gilbert et al. . | |
| 4,577,794 | 3/1986 | Armstrong et al. | 29/710 X |
| 4,604,889 | 8/1986 | Sukharevsky . | |
| 4,790,470 | 12/1988 | Miles . | |

OTHER PUBLICATIONS

Phillips Plastics Corporation, Product Bulletin entitled Automatic and Semi-Automatic Equipment for Rapid Fastener Assembly.

Nasco Industries Inc. Bulletin entitled 2001 Puts You on Top an Odyssey in Productivity.

*Primary Examiner*—Timothy V. Eley

*Attorney, Agent, or Firm*—Knobbe, Martens, Olson & Bear

[57] ABSTRACT

A powered fastener installation apparatus and method wherein the successful installation of a fastener is indicated by directly detecting the event of the fastener stem breaking. The device releases any partially upset fastener before withdrawing from the workpiece so as to prevent damage to the workpiece. The fastener installation device includes means for transferring the fastener from a feed module to the pulling head and avoiding partial upsetting or disassembly of the fastener, which can lead to jamming the device. The pulling head and transfer apparatus are provided with a vacuum to retain the fastener without mechanical gripping, thereby allowing easy purging of the fastener and preventing the fastener from falling out of the device unintentionally. Moreover, use of the vacuum retention allows greater flexibility and tolerance of errors in the placement and angular orientation of the robot arm and workpiece. The load and feed phases of the cycle overlap to reduce cycle time and can occur while the apparatus is being moved to a second fastener installation location.

11 Claims, 14 Drawing Sheets

Fig. 8
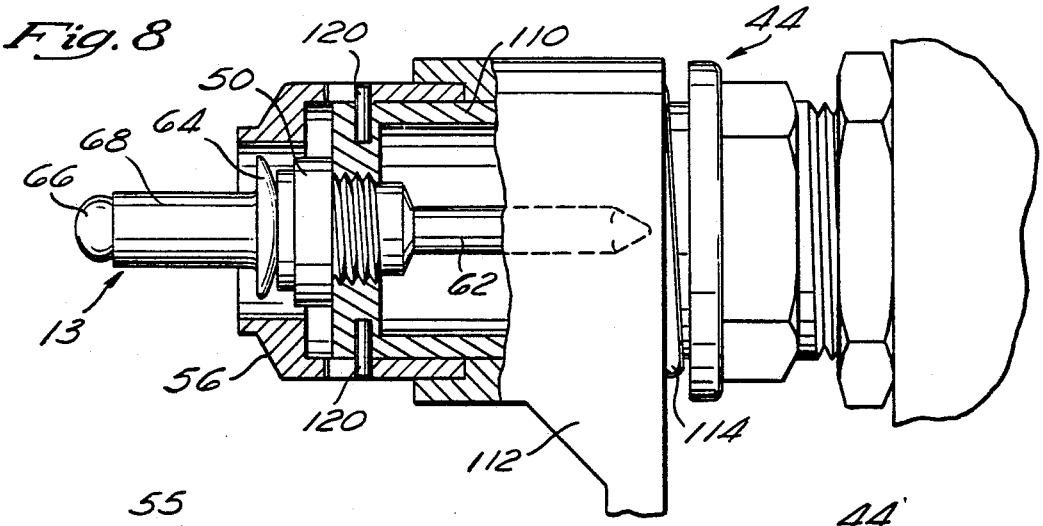
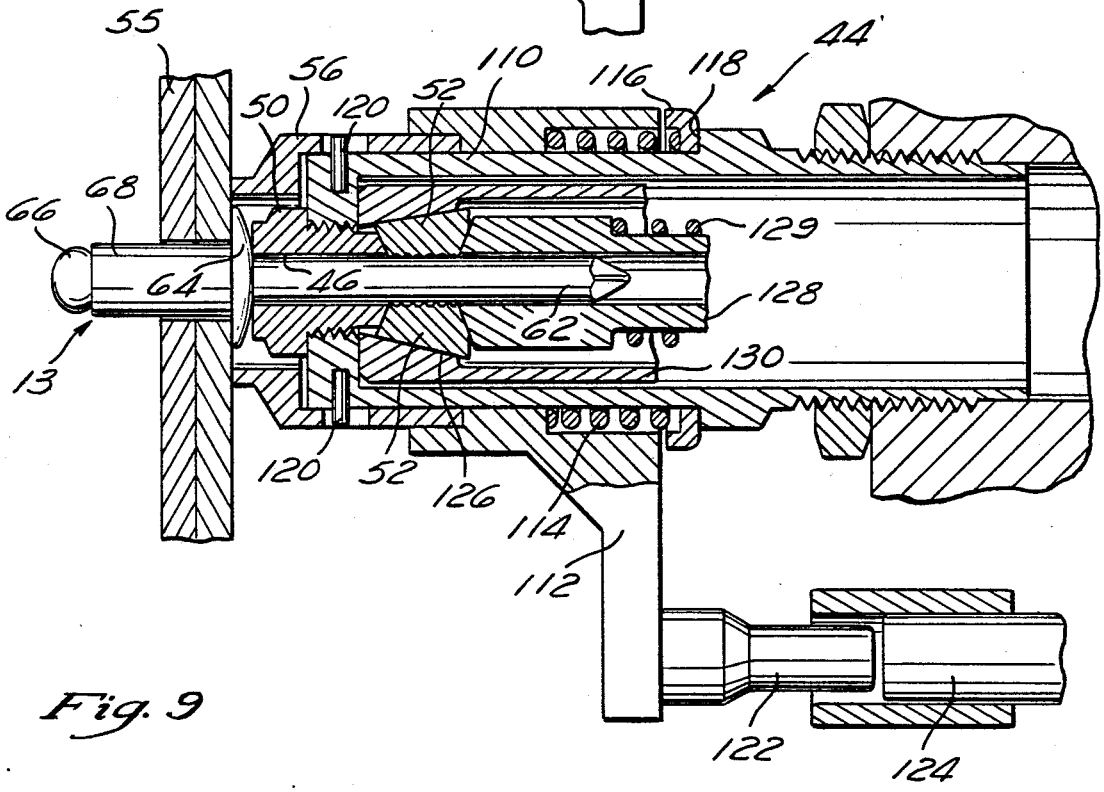
Fig. 9

Fig. 10
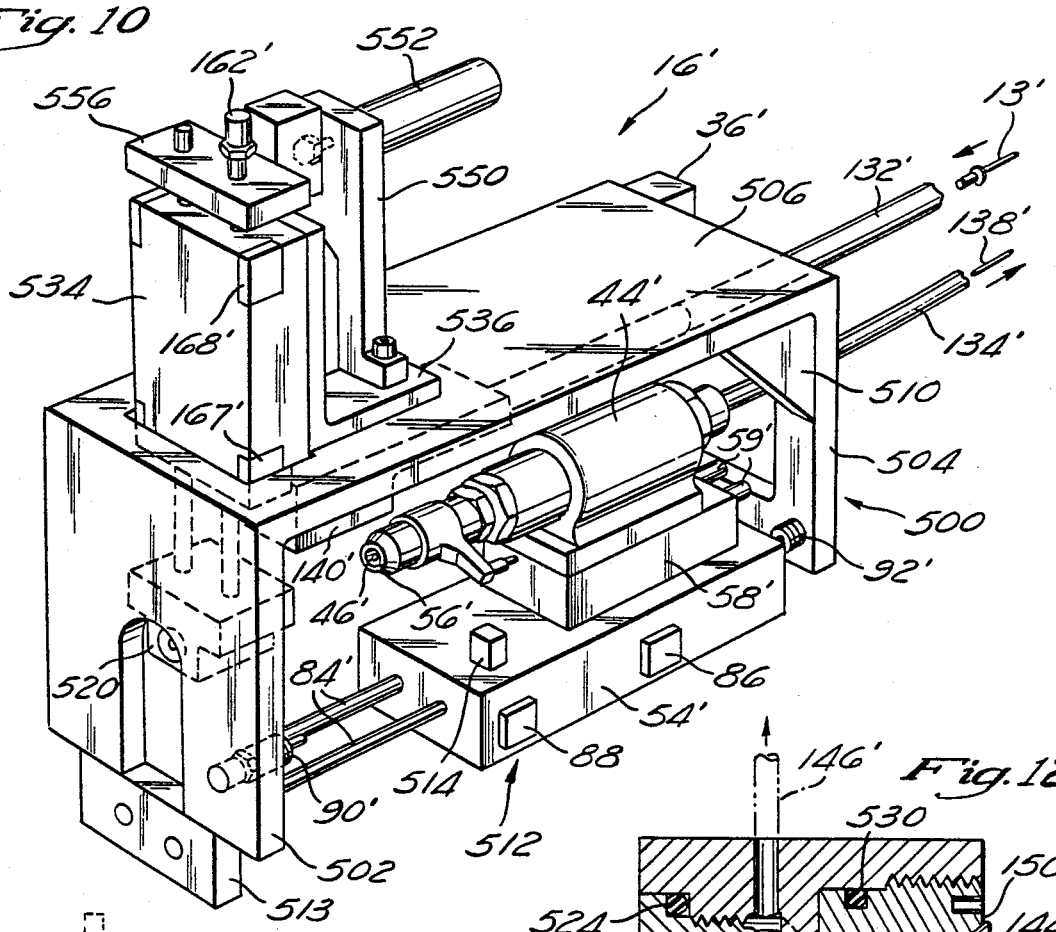
Fig. 12
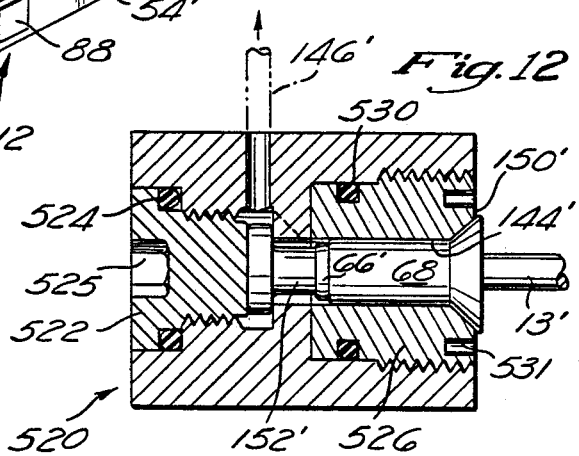
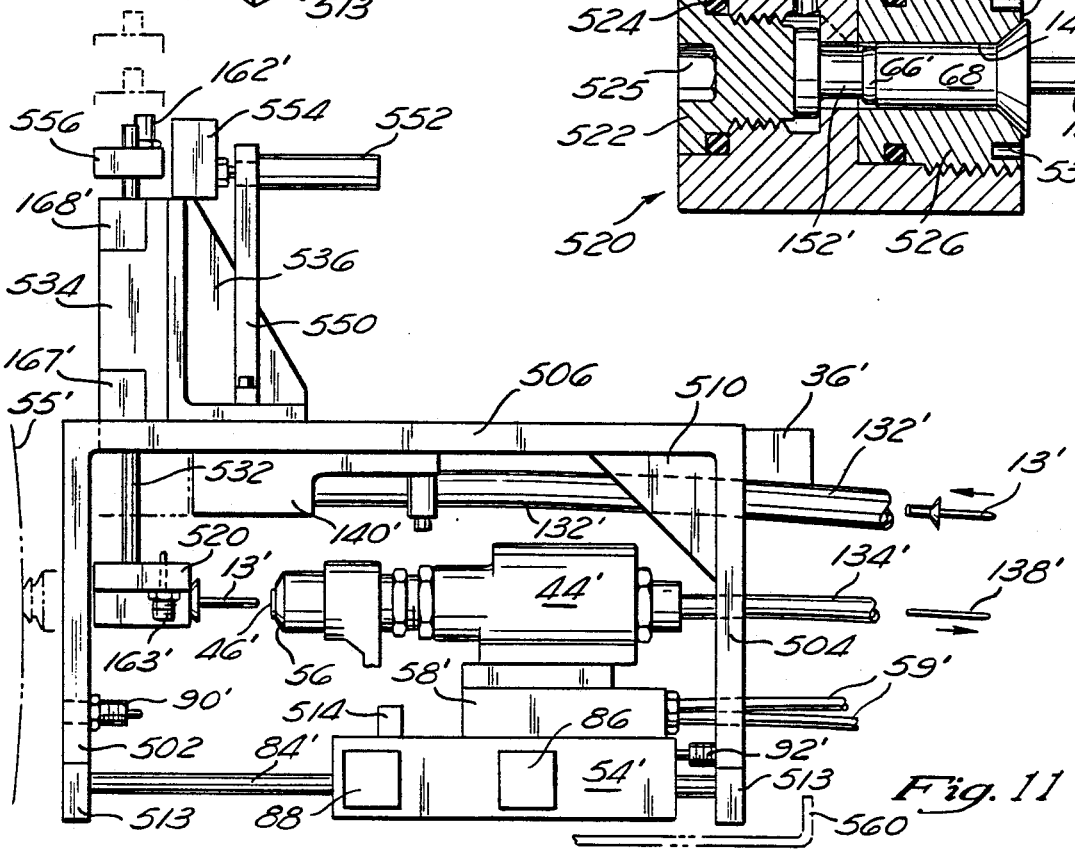
Fig. 11

POWERED FASTENER INSTALLATION APPARATUS

BACKGROUND OF THE INVENTION

This invention relate to power operated fastening devices, and in particular, to an apparatus and method for installing fasteners.

A blind rivet is generally composed of two pieces. The first piece is the mandrel or stem, a cylindrical member having an enlarged head at one end. The second piece is the sleeve, a generally tubular member abutting the stem head, with an outwardly protruding flange at its end opposite the stem head. In use, such a fastener is typically placed in the pulling head of a powered fastener installation device and directed to the workpiece. In other instances, the fastener is placed in the workpiece and the powered fastener installation device then applied to it. The stem of the fastener is gripped by the jaws of the fastener installation device pulling head, which is then operated by hydraulic pressure to clamp the jaws radially about the fastener stem and pull the stem rearward away from the workpiece. The tension on the stem pulls the stem head against the sleeve, thereby deforming the sleeve against the rear surface of the workpiece. The fastener is constructed so that the stem breaks off at a predetermined load limit and at a predetermined location on the stem. A fastener may also be set by a powered fastener installation device by rotating the stem, thereby breaking off the stem on reaching a pre-determined rotational stress limit.

Traditionally, installation of such fasteners has been performed by an operator using a hand-held powered fastener installation apparatus. More recently, however, the powered fastener installation has been accomplished in conjunction with industrial robots or other automated positioning devices. Use of such robots has many attendant benefits in the manufacturing process. However, their use also has disadvantages in the installation of fasteners. For example, powered fastener installation devices used in conjunction with industrial robots have traditionally operated quite slowly. A human operator experienced in powered fastener installation can install fasteners with a comparable or superior rate of speed for at least a short period of time. Another drawback is that robot mounted powered fastener installation devices risk damaging the workpiece. For instance, if the jaws of the pulling head become fouled, the jaws may slip along the fastener stem, resulting in a loss of pulling force and a partially upset fastener. If the robot withdraws the powered fastener installation apparatus from the workpiece with the jaws clamped to a partially upset fastener, the fastener may be pulled from the workpiece aperture, possibly deforming the workpiece surface. Such a mishap can ruin a very expensive workpiece. On the other hand, the jaws could slip entirely off the partially upset fastener and leave the fastener protruding from the workpiece. Although this problem does not damage the workpiece in and of itself, it reduces the efficiency of the device, fails to fasten the workpiece, possibly interferes with the robot's movement, and leaves a fastener projecting from the workpiece, creating a potentially damaging or hazardous lever—which can deform the workpiece—or projectile—which can injure the operator or damage the workpiece or machinery.

Another drawback with robot-mounted powered fastener installation devices of the prior art is that they install the fasteners by a "blind" pull. That is, the pulling head pulls on the fastener stem until a pre-determined time has elapsed, a pre-determined pressure has been reached, or until it has pulled for a pre-determined length. None of these methods directly indicate whether the fastener stem has been broken. Thus, the robot can be fooled into thinking that the fastener has been upset. Slipping of the jaws on the fastener stem or some other problem can lead to failure to install the fastener, or worse yet, withdrawal of a partially upset fastener through the workpiece aperture.

A similar problem can occur in the prior art devices if the robot or workpiece is slightly misaligned so that the fastener is not inserted into the workpiece aperture, but instead abuts the workpiece surface. The fastener may be upset into thin air, fooling the robot into thinking that it has been successfully installed. An associated problem is that deflection of the fastening device due to slight misalignmnt is transferred either to the workpiece or to the robot, risking damage or misalignment of both.

A further drawback to the robot-mounted powered fastener installation devices of the prior art is their susceptibility to fastener feed problems resulting from the irregular shape of the fasteners and the complexity of the mechanism. Robot mounted fastener installation devices are notorious for their jamming problems. To further compound this problem, pneumatic conveying of fasteners can result in partial or total disassembly of the fastener. As a result, such devices are reputed to be unreliable and costly in terms of downtime.

One characteristic of robot-mounted powered fastener devices that is incompatible with many standard powered fastening devices is that the robot arm may be called upon to insert the fastener in any orientation, including facing down. Thus, unless the fastener is positively held in place, it may fall out by the force of gravity before it is installed in the workpiece. The robot would have no way of knowing that the fastener had fallen out. Consequently, the prior art has endeavored to mechanically grip the fastener throughout the cycle. Mechanical gripping, however, makes it difficult to purge the apparatus if required.

SUMMARY OF THE INVENTION

The present invention is an apparatus and method of installing a fastener into a workpiece by inserting the fastener, pulling the fastener stem until it breaks, detecting the breaking of the fastener stem, and releasing the fastener stem upon detecting the breaking of the fastening stem. This method and apparatus will insure that the operator will be alerted to a failure to install the fastener and that the fastener installation device will not pull a partially upset fastener from the workpiece surface, thereby damaging the workpiece. In a preferred embodiment of the present invention, the event of the fastener breaking is detected directly by means of an accelerometer.

The apparatus and method of the present invention includes a mechanism for receiving a pneumatically conveyed fastener from a feed module and transferring it to a pulling head without separation of the fastener sleeve from the fastener stem or partial upsetting of the fastener. This mechanism in one form has a substantially planer surface with a generally circular orifice for receiving the fastener flange and a second surface disposed rearward of the first surface in alignment with the orifice, the distance between the first and second surfaces being substantially equal to the length between the fastener flange and the end of the fastener stem head. The first surface stops the flange of the pneumatically conveyed fastener at the same time that the second surface stops the stem head of the pneumatically conveyed fastener so that the fastener is neither partially upset nor separated into two pieces. In a particularly preferred embodiment, the mechanism for receiving the pneumatically conveyed fastener is provided with a vacuum to the orifice so that the vacuum acts to retain the fastener securely in the mechanism. The difference between the pressure of the vacuum with and without a fastener present may be monitored to indicate whether a fastener is present in the mechanism. This is done by determining a reference pressure equal to the pressure of the vacuum when no fastener is present, monitoring the pressure of the vacuum, and indicating the presence of a fastener by the difference between the reference pressure and the monitor pressure.

The present invention includes a pulling head in which the fastener is retained in a pulling head nosepiece orifice having a diameter greater than that of the fastener sleeve by supplying a vacuum to the orifice of a sufficient pressure to purge the fastener against a forward surface of the pulling head nosepiece. This apparatus and method for retaining without mechanically gripping a fastener in the pulling head nosepiece allows easy purging of the fastener from the nosepiece and affords lateral and angular flexibility of the fastener, which facilitates transfer of the fastener to and from the apparatus and enhances the tolerance of the device to locational and angular errors in the workpiece and robot arm.

The pulling head of the present invention may be configured to detect the insertion of a fastener into the workpiece aperture by providing a nosepiece abutting the rear face of the fastener flange for holding the fastener about its stem, a collar reciprocal with respect to the nosepiece surrounding and extending forward of the flange for contacting the workpiece, and a detector actuated by the collar for detecting when the flange is close to or abutting the workpiece surface.

The installation system of the invention is particularly fast and efficient. A robot moves the installation device to the proper fastener installation location. The robot sends a signal to initiate an installation cycle, and the robot is prohibited from further movement. A pulling head is then moved forwardly to insert a first fastener, and the pulling head is actuated to set the fastener. The pulling head is then retracted; and when it has adequately cleared the workpiece, a signal is given to release the prohibition on the robot so that it can move the installation device to a second location. After further retraction of the pulling head, a second fastener is automatically loaded into the pulling head by the previously fed fastener transfer device, so that in most instances a fastener is ready to be installed as soon as the robot has moved the device to the second location. Also, as soon as the transfer device is returned to its home position and senses the absence of a fastener in it, a third fastener is provided to it by fastener feed means. Thus, the fastener installation, fastener load, and fastener feed phases of the cycle advantageously overlap to save time, and the load and feed cycles function while the robot is moving the apparatus.

The system of the invention also includes numerous checks for errors and recycling steps. These self-correcting techniques help prevent unnecessary shut-down and help diagnose problems if shut-down is needed. At the same time, safety and protection is afforded to the workpiece, to the installation device, and to operator personnel.

BRIEF DESCRIPTION OF THE DRAWINGS

FIG. 8 is a fragmentary cross-sectional view of the pulling head of the fastener installation module shown with a fastener inserted in the nosepiece.

FIG. 9 is a fragmentary cross-sectional view of the pulling head of FIG. 8, shown in the position in which the fastener is delivered to the workpiece.

FIG. 10 is a perspective view of an alternate embodiment of the powered fastener installation apparatus of the present invention.

FIG. 11 is an elevational view of the apparatus of FIG. 10.

FIG. 12 is a cross-sectional view of the pick and place slide block of the apparatus of FIG. 10.

DETAILED DESCRIPTION OF THE PREFERRED EMBODIMENT

Figure 1:
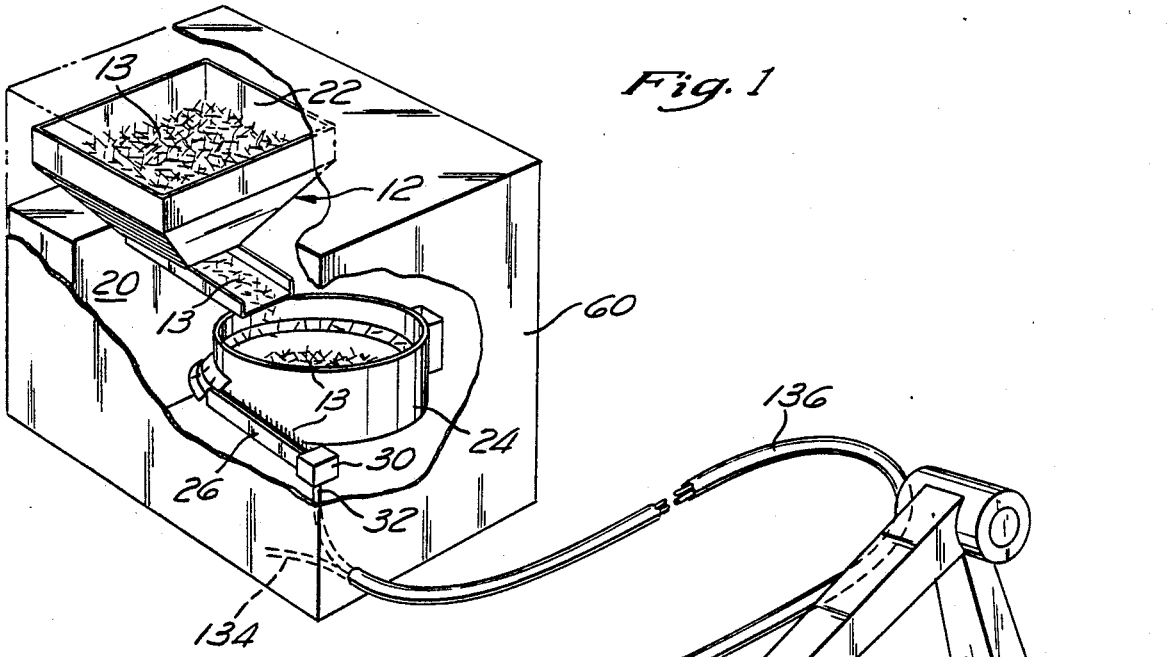
FIG. 1 is a perspective view of the powered fastener installation apparatus of the present invention.

FIG. 1 shows the powered fastener installation apparatus 10 of the present invention. That apparatus generally comprises four components, the feed module 12, the robot 14, the fastener installation module 16 and the control module 20. Robot 14 may be a standard industrial robot. One of ordinary skill in the art, however, will also recognize that a human operator could take the place of robot 14 in the powered fastener installation method of the present invention.

The feed module 12 includes a storage hopper 22, in which the operator places fasteners 13 from a bulk shipping or storage container. The storage hopper 22 delivers fasteners 13 to the sorting bowl 24, where the fasteners 13 are sorted to discard improper materials, such as disassembled fasteners, dust, debris, screws and fasteners of improper size. The sorting bowl 24 further orients and aligns the fasteners 13 and delivers them to feed track 26. The feed track 26 provides a series of sorted and aligned fasteners 13 to the escapement 30. The escapement 30 selects one fastener 13 at a time from the feed track 26 and delivers it to fastener feed tube 32. The fastener 13 is pneumatically propelled through the fastener feed tube 32 to the fastener installation module 16.

Figure 2:
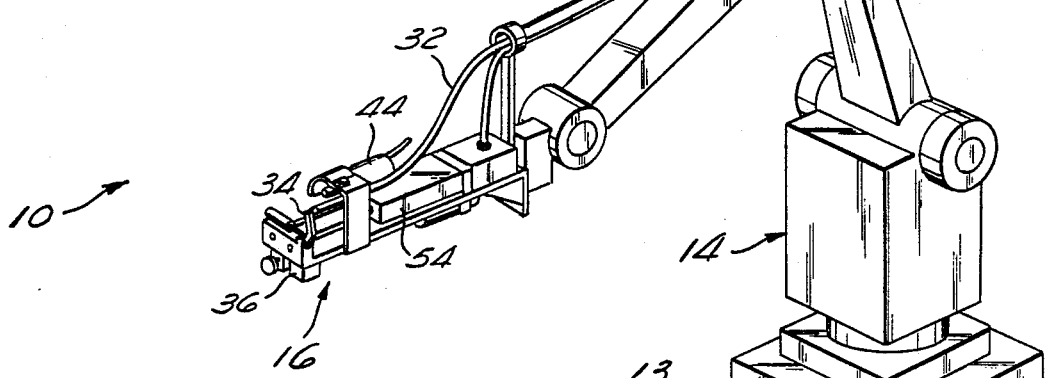
FIG. 2 is a perspective detail view of the fastener installation module of the apparatus of FIG. 1.
Figure 2:
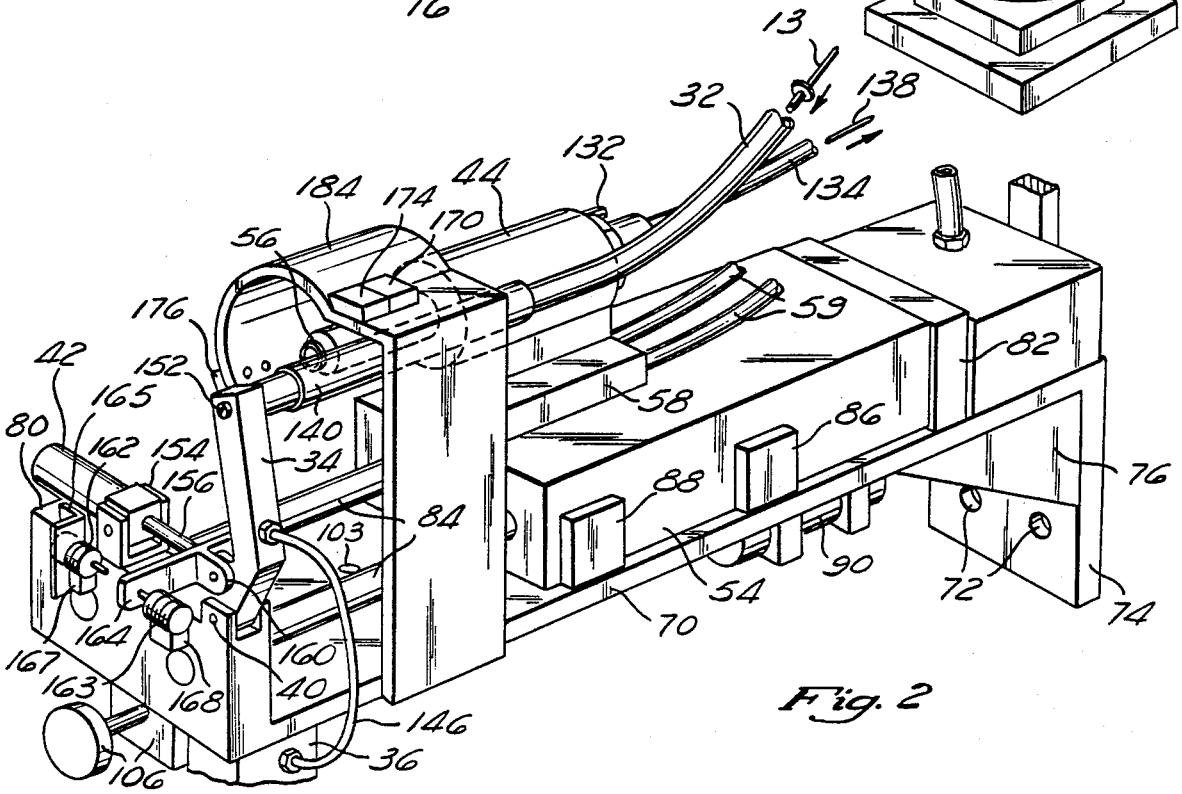

Referring to FIG. 2, the fastener feed tube 32 delivers the fastener 13 to a transfer device or apparatus that includes a pick and place arm 34, which receives the fastener from the tube 32. The fastener is held in place in the arm 34 by a vacuum generated by a pump 36. The pick and place arm 34 is rotatable about a hinge pin 40 and is rotated by a pneumatic cylinder 42. As shown more clearly in FIG. 4, actuation of the pick and place arm cylinder 42 causes the pick and place arm 34 to rotate the fastener 13 from axial alignment with the fastener feed tube 32 into alignment with the pulling head 44. More particularly, the fastener 13 is axially aligned, as shown more clearly in FIG. 9, with the aperture or chamber 46 through the pulling head nosepiece 50 and pulling head jaws 52. The fastener 13 may be transferred from the pick and place arm 34 to the pulling head 44 by removing the vacuum through the pick and place arm 34 and providing a positive air pressure to expel the fastener 13. The pulling head slide 54, with the fastener 13 held in place by vacuum, retracts rearwardly to its full back position. Extension of the pick and place arm cylinder 42 causes rotation of the pick and place arm 34 back into alignment with the feed tube 32, clearing the arm 34 from the path of the pulling head 44.

Once a fastener 13 has been inserted into the pulling head 44, the pulling head 44 may be moved forward by means of the slide 54. Linear forward movement of the slide 54 causes linear forward movement of the fastener in the pulling head 44 toward the workpiece 55. FIG. 8 shows a fastener 13 placed in the pulling head 44. FIG. 9 shows a fastener 13 placed in a workpiece 55 to the position that the pulling head 44 is at its forward position. In this position, the fastener 13 is seated and ready to be upset, or installed. This position is indicated by depression of the pulling head collar 56. In order to install the fastener 13, the pulling head 44 is actuated, and jaws 52 are radially clamped about the fastener stem 62 and laterally withdrawn away from the workpiece 55. This action, coupled with the biasing force applied to the fastener flange 64 by the nosepiece 50, causes the fastener 13 to be upset. The fastener stem head 66 compresses and deforms the sleeve 68 until the stem 62 breaks. It will be understood by one of ordinary skill in the art that this general arrangement may also be utilized with breakstem fasteners that rotate the fastener stem rather than pull it. Similarly, one of ordinary skill in the art will appreciate that the present invention may be utilized with fasteners other than blind rivets as shown in the drawings. For example, the present invention could be utilized with lockbolt or other fasteners.

Once the fastener 13 is installed in the workpiece 55, the slide 54 is retracted to its rearmost position. This clears the workpiece 55 and allows the robot 14 to move to the next position or workpiece.

To fully understand the advantages of the invention, it is desirable to first describe individually the construction of the various modules of the invention, followed by a description of the manner in which these modules function together to accomplish the purposes and objectives of the invention.

FEED MODULE

The feed module 12 comprises the storage hopper 22, sorting bowl 24, feed track 26 and escapement 30. The storage hopper 22 allows the operator to load a large amount of fasteners 13 from a bulk container into the feed module 12. It has been found convenient to provide for acceptance of at least 10,000 fasteners. Of course, the capacity can be varied without affecting the present invention, but the greater the capacity, the less the need for attention by an operator.

The storage hopper 22 is preferably vibratory so as to distribute fasteners 13 to the sorting bowl 24. The sorting bowl 24 orients the fasteners 13 and sorts out improper materials, such as fasteners of improper size, disassembled fasteners, dust or other debris. The sorting bowl 24 orients and aligns the fasteners 13, and directs them to vibratory feed track 26. While the feed track 26 is preferably in a continuous vibratory mode to prevent the fasteners 13 from becoming jammed in the feed track 26, the vibratory motion of the sorting bowl 24 is controlled by a suitable detector (not shown) which monitors the amount of fasteners 13 in the feed track 26. Once the amount of fasteners 13 in the feed track 26 drops below a predetermined minimum level, the sensor, which may conveniently comprise a photoelectric emitter and detector, initiates the vibration of the sorting bowl 24. The sorting bowl 24 is vibrated until the level of fasteners 13 in the feed track 26 reaches the predetermined level. The detector then shuts off the vibration, halting further feeding of fasteners until the level in the feed track 26 once again drops below the predetermined minimum. Likewise, vibration of the storage hopper 22 is controlled by the level of fasteners 13 in the sorting bowl 24. This level may be conveniently detected by a rotary switch (not shown) having connected thereto a paddle projecting into the sorting bowl 24.

The fasteners 13 on the feed track 26 are removed one at a time by the escapement 30 and placed in the fastener feed tube 32. Delivery of the fastener 13 from the feed module 12 to the fastener installation module 16 is effected by providing an air blast into the fastener feed tube 32 to propel the fastener 13 therethrough.

One of ordinary skill in the art will immediately recognize that the storage hopper 22, sorting bowl 24, feed track 26 and escapement 30 of the present invention are all commonly known in the art. That is, one of ordinary skill in the art will recognize that there exist a number of suitable ways in which to construct a storage hopper 22, sorting bowl 24, feed track 26 and escapement 30. The details of these devices accordingly warrant no further description here. Moreover, the present invention could be used with a feed module in which the fasteners are provided in some ordered fashion, rather than in bulk.

The feed module 12 may be conveniently enclosed within an enclosure 60 along with the control module 20. The enclosure 60 may be conveniently provided with wheels (not shown) so as to operate as a movable cart to allow placement of the feed module 12 and the control module 20 with respect to the robot 14 so as to keep the feed module 12 and control module 20 away from the path of the robot 14.

FASTENER INSTALLATION MODULE

Figure 6:
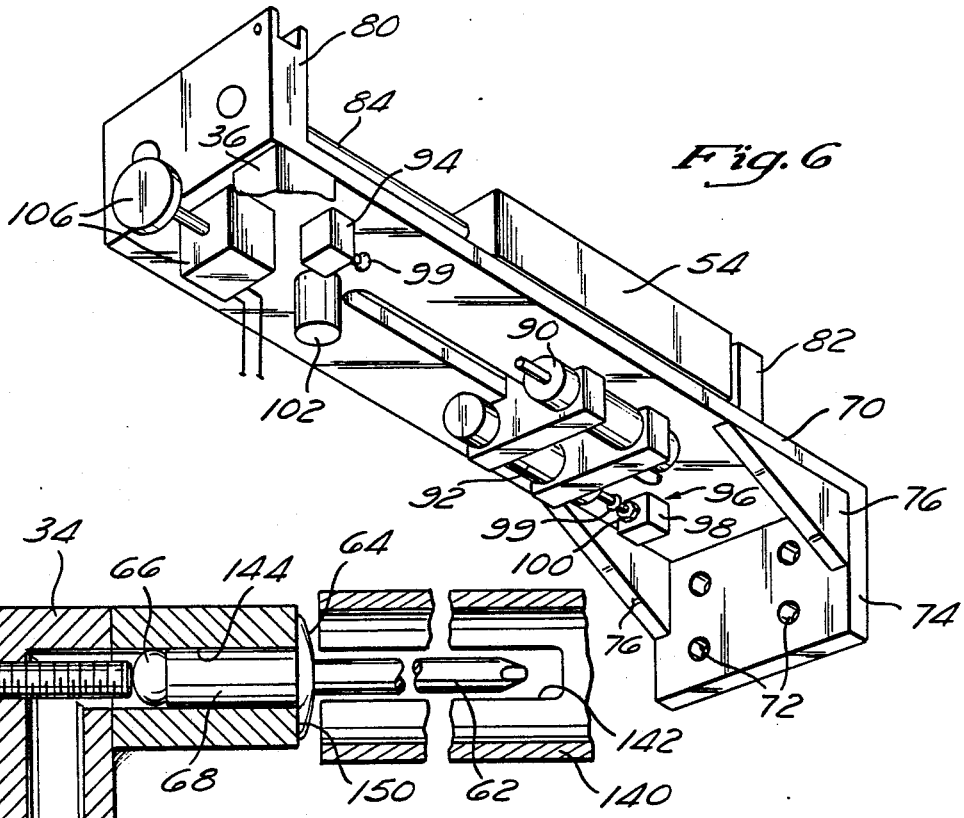
FIG. 6 is a perspective bottom view of the fastener installation module of FIG. 2.

The fastener installation module 16 is constructed about a base member 70, as shown in FIG. 2. As shown in FIG. 6, the base member 70 has provided at its rear end means for attaching the base member 70 to the arm of robot 14. This means for attaching the base member 70 to the robot 14 may conveniently include mounting holes 72 formed in attachment plate 74. Suitable stiffening means such as, for example, gussets 76, may be provided to minimize deflection of the fastener installation module 16 and enhance the accuracy of fastener placement of the powered fastener installation apparatus 10. Enough flexibility should be retained, however, to allow for minor deflection encountered by insertion of a fastener 13 into a workpiece 55 in which the aperture is slightly misaligned. Misalignment may occur due to variance in the workpiece 55, the aperture, or inaccuracies in the positioning of the robot 14. It is desirable to absorb this deflection in the fastener installation module 16 rather than in the workpiece 55, because the resulting movement could damage the workpiece 55 or ruin its alignment. Flexibility is also supplied by the apparatus for holding the fastener 13 in the pulling head 44, as is discussed further below.

Referring to FIG. 2, mounted to fastener installation module base member 70 are upstanding support members 80, 82. Mounted therebetween are spaced, parallel, horizontal guide rods 84. Slidably mounted on guide rods 84 is slide 54. Slide 54 is mounted on guide rods 84 so as to allow reciprocation as directed by pneumatic pressure. Such pneumatic slide arrangements, including support members 80, 82 guide rods 84, and slide 54, are commonly known in the prior art, and it has been found convenient to utilize a standard slide such as manufactured by PHD, Inc., Fort Wayne, Ind. 46899. Of course, one of ordinary skill in the art will appreciate that the reciprocal slide may be of a number of forms, including hydraulic, a ball screw mechanism, etc.

Slide 54 may be conveniently provided with back limit switch 88 to indicate when the slide 54 is in its back position. It is also convenient to provide a clearance limit switch 86 to indicate when the slide 54 has travelled away from the workpiece 55 to a point where the pulling head 44 has cleared the workpiece 55. Although a number of detector arrangements could be utilized, it has been found convenient to use proximity switches and accompanying mounting brackets provided by the above-mentioned slide manufacturer.

Figure 5:
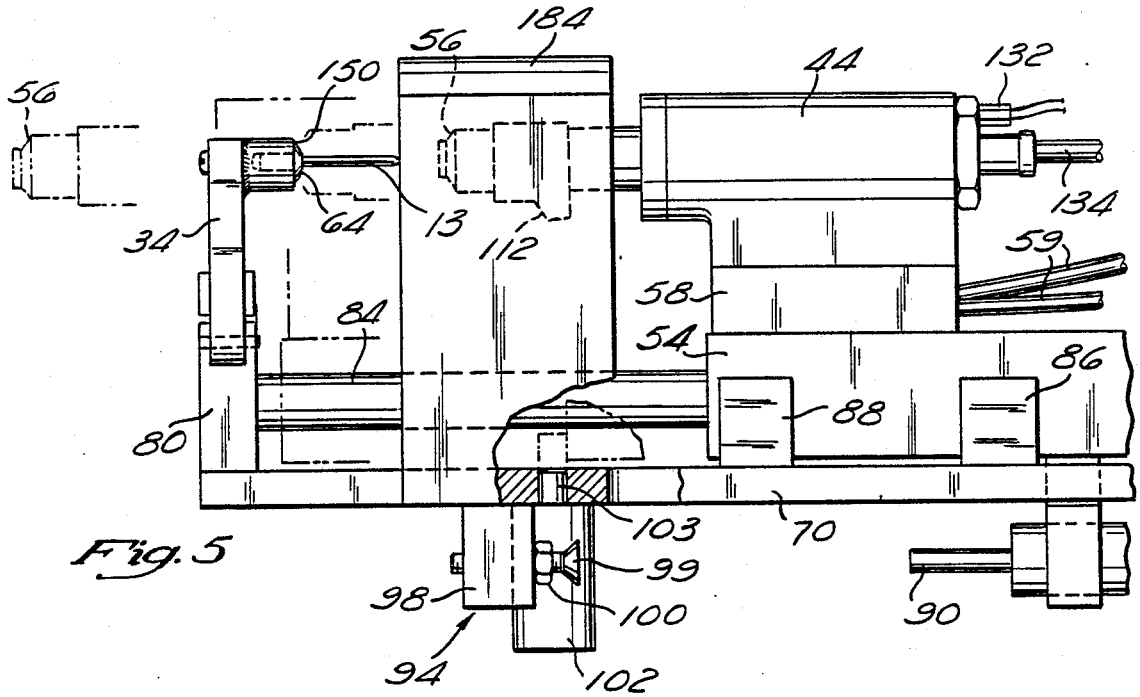
FIG. 5 is an elevational view of the fastener installation module of FIG. 2, showing the slide in the back position, and in phantom, showing the slide in the forward position.

As shown in FIG. 6, attached to the bottom of slide 54 and mounted below fastener installation module base member 70 are forward dampener 90 and rearward dampener 92. Dampeners 90, 92 are secured with respect to the slide 54 and reciprocate therewith. As shown in FIGS. 5 and 6, forward dampener 90 is aligned with forward adjustable stop 94. Cooperation of the forward dampener 90 and the forward adjustable stop 94 results in controlled deceleration of the slide 54 near the end of stroke and precise control of the forward end-of-stroke position for pulling head 44. The adjustable stops 94, 96 may be conveniently fashioned from a block 98 which protrudes down from the bottom of the fastener installation module base member 70 and is threaded to receive a screw 99. The screw 99 is adjusted to the desired position and locked in place by means of a jam nut 100. In order to adjust the adjustable stops 94, 96, the slide 54 is placed in its corresponding end-of-stroke positions, and screws 99 are adjusted to compress dampeners 90, 92. Jam nuts 100 are then securely tightened against blocks 98. The dampeners 90, 92 may take any of a number of suitable forms. For example, they may be pneumatic, hydraulic or mechanical. Their purpose is to provide smooth deceleration of the relatively rapid reciprocation of slide 54. It has been found convenient to utilize pneumatic dampeners such as provided by Ace Controls, Inc., Farmington, Mich. 48024. It should be apparent that the dampeners 90, 92 could be mounted on the base member 70 and the adjustable stops could be conveniently mounted on the slide 54.

Use of a slide 54 to insert the fastener 13 into the workpiece 55 is desirable for the flexibility and tolerance it lends to the system. A fastener installation device without such an arrangement relies on the robot 14 to axially position the fastener 13 into the workpiece 55. That reliance compounds the difficulty of rivet insertion by adding another axis of potential error. The linearly reciprocal apparatus of the present invention affords greater latitude in the distance, measured on the axis of the fastener 13, between the theoretical and actual location of the workpiece 55.

Referring to FIGS. 5 and 6, attached to the underside of base member 70 is a pneumatic stop cylinder 102 which actuates a vertically reciprocal hard stop 103. Stop 103 acts to halt forward linear movement of the slide 54 so that the nosepiece 50 of pulling head 44 is closely proximate the fastener flange 64 of the fastener 13 against pick and place arm face 150. Stop 103 is only raised when the pulling head 44 is to receive a fastener 13 from the pick and place arm 54.

Referring to FIG. 6, shown mounted on the front underside of fastener installation module base member 70 is an adjustable emergency stop switch 106. Stop switch 106 is connected to the robot 14 and provides an indication that the fastener installation module 16 has proceeded forwarded into a workpiece 55 or other object. Thus, the stop switch 106 is adjusted so that it is not actuated during normal installation of a fastener 13. Only if the fastener installation module 16 has been extended closer to an object than it is intended to be extended with respect to the workpiece 55, should the stop switch 106 be actuated. This ensures that the stop switch 106 will not impede the operation of the fastener installation module 16 during normal fastener installation, but will prevent the robot 14 from pushing the fastener installation module 16 through the surface of a workpiece 55 or other object which is out of its intended position. The stop switch 106 is not a true component of the fastener installation module 16, but is part of the operating circuit of the robot 14. Accordingly, the stop switch 106 is preferably not connected to the control module 20 of the fastener installation apparatus 10, but is directly connected to the robot 14. The stop switch 106 may be fashioned from any of a number of devices, including the whisker-type limit switch with disc depicted in FIGS. 1–3 and 6.

Mounted on the top of the slide 54 is the manifold 58. The manifold 58 accepts pressurized fluid from the pneumatic and hydraulic lines 59 for actuating the pulling head 44. The pulling head 44 is mounted on top of the manifold 58. The pulling head 44 may be conveniently provided similar to that of the standard powered fastener installation device for the particular fastener to be utilized. For example, as shown in FIGS. 8 and 9, the pulling head 44 is of the standard configuration used for powered blind rivet installation tools. The only addition to the standard tool is the collar 56 and its associated mechanism. As shown in FIG. 9, collar 56 is slidably mounted on the exterior front portion of sleeve 110 and abuts against slidably mounted arm 112. The arm 112 and the collar 56 are urged forward by spring 114 which reacts against spring retainer 116, which in turn abuts against shoulder 118 on the sleeve 110. Collar 56 is retained in place by pins 120. The collar 56 may be conveniently provided with a bayonet-style mount for ease of assembly. One of ordinary skill in the art will recognize that a number of mechanisms for reciprocally mounting the collar 56 could be substituted for the bayonet-style mount shown.

The arm 112 reciprocates with the collar 56. A proximity target 122 is attached to and reciprocates with the arm 112. When the collar 56 is depressed, as shown in FIG. 9, the proximity target 122 is placed in close relation with a proximity detector 124. Of course, one of ordinary skill in the art will recognize that the linear motion of the collar 56 may be translated into an electric signal by means other than a proximity detector, including a photoelectric or linear detector. Similarly, a detector may be arranged to detect the presence of the workpiece directly, rather than the proximity target 122 depending from the arm 112, which is actuated by the collar 56.

As shown in FIG. 9, the fastener stem 62 projects through the nosepiece 50 into the interior of the pulling head 44. The fastener flange 64 abuts the nosepiece 50 and the fastener stem 62 is surrounded by the jaws 52 of the pulling head 44. A vacuum is provided to the interior of the pulling head 44 via the fastener stem ejection tube 134 (FIG. 5). The vacuum acts to urge the fastener 13 securely into the nosepiece aperture 46 and retain it therein. Use of the vacuum allows orientation of the robot arm in any direction without the fastener 13 falling out due to the force of gravity. The nosepiece aperture 46 is preferably of a greater diameter than the fastener stem 62. The clearance allows the vacuum to act against fastener flange 64, but more importantly, allows angular and lateral displacement of the fastener 13. Angular or lateral displacement may allow insertion of the fastener 13 into a workpiece 55 in which the aperture is slightly misaligned without causing deflection of the entire fastener installation module 16.

Referring to FIG. 9, the jaws 52 are radially arranged about the fastener stem 62 inserted into the pulling head 44. Surrounding and abutting the inclined surface 126 of the jaws 52 is the compression collet 130. In order to upset and install the fastener 13, hydraulic pressure is applied via a hydraulic piston (not shown) to the compression collet 130, drawing it rearward away from the workpiece 55. Cooperation at inclined surface 126 causes the jaws 52 to be radially clamped about the stem 62 of the fastener 13 and rearwardly drawn away from the workpiece 55. As is commonly known in the art, pulling the stem 62 away from the workpiece 55 causes the head 66 of the stem 62 to compress the fastener sleeve 68, until the workpiece is sandwiched between the fastener flange 64 and the deformed fastener sleeve. Eventually, the fastener stem 62 breaks at a predetermined location under the tensile stress.

Biasing the jaws 52 forward is the plunger 128 and spring 129. Thus, once the hydraulic pressure is released, the plunger 128 forces jaws 52 forward. Once the jaws 52 contact the rear of the nosepiece 50, they are forced apart radially. The details of this construction are well known in the art and need no further discussion here.

The event of breaking the fastener stem 62 is detected by an accelerometer 132 proximate the pulling head 44. As shown in FIG. 5, the accelerometer 132 may be conveniently fastened at the rear of the pulling head 44. The location of the accelerometer 132 is dictated by two considerations. First, the accelerometer 132 should be located as close as possible to the location at which the fastener stem 62 is broken. This ensures detection of the event of the stem breaking. Second, the accelerometer 132 should be located so as to avoid interference with any moving parts or obstruction by debris. One of ordinary skill in the art will recognize that the event of the fastener stem 62 breaking may be detected by a number of suitable means, including a microphone or load cell.

Use of an apparatus or method for detecting the physical separation of the fastener stem 62 from the installed fastener by detecting the physical reactive force from the separation or the sound generated by the separation is far superior to prior art methods of monitoring installation of fasteners. In the prior art, automatic fastener installation apparatus and methods employed unverified installation. In other words, these apparatus and methods measured the pressure level applied by the pulling head for a timed period, measured the pressure applied to the pulling head, or measured linear displacement of the pulling head, or measured a combination of these. Each of these methods indirectly or inferentially measured the event of fastener installation, but were unverified. An accelerometer, microphone or load cell directly measures the actual event of successful rivet installation by determining a sudden change in pressure energy. Thus, the accelerometer 132 provides a much-preferred method of detecting fastener installation.

Figure 3:
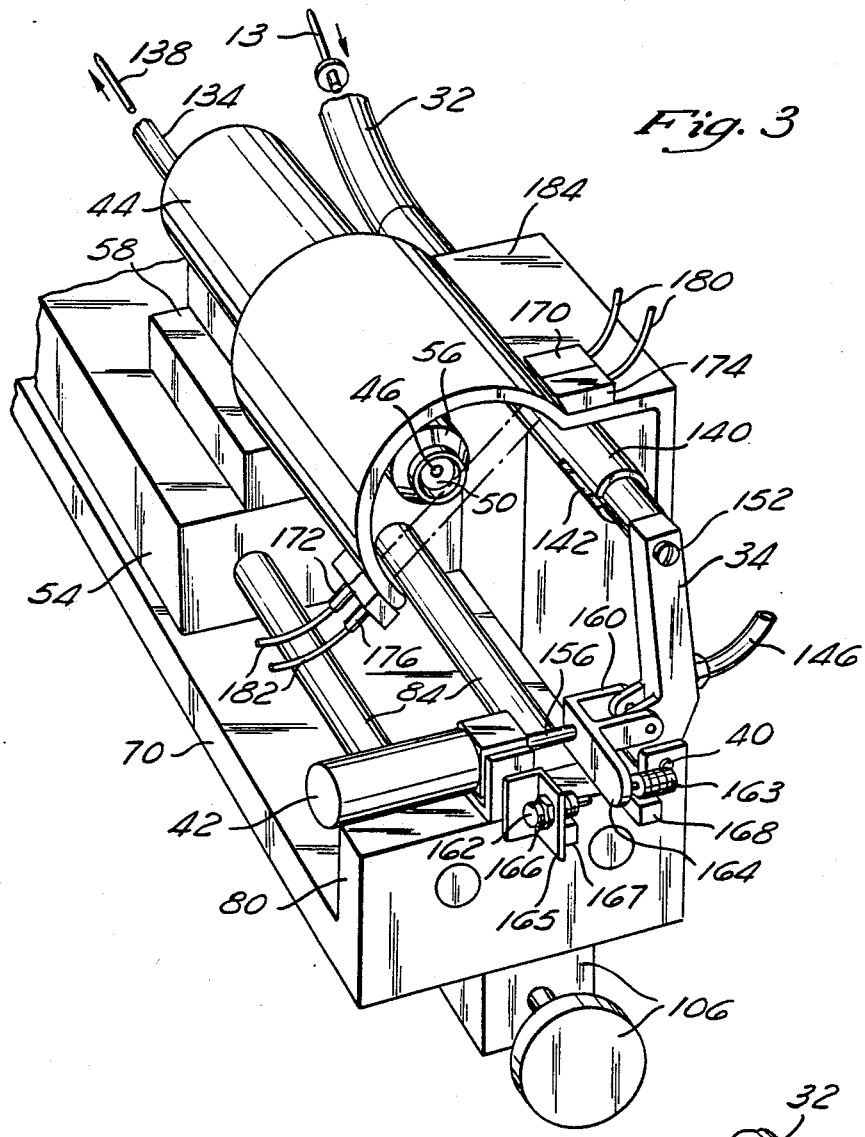
FIG. 3 is another perspective view of the fastener installation module of FIG. 2.

As shown in FIGS. 2 and 3, fastener stem ejection tube 134 is attached to the rear of the pulling head 44. The fastener stem ejection tube 134 may be routed with the fastener feed tube through a conduit 136 to a waste receptacle in the enclosure 60. It may also be individually routed to a separate spent stem collector.

In FIG. 1, the electrical, pneumatic and hydraulic connection between the fastener installation module 16 and the control module 20 and feed module 12 are bundled and commonly conveyed through an umbilical conduit 136. This arrangement is preferred to individual routing from remote locations because it is simpler and it maximizes the freedom and ease of movement of the robot 14.

Figure 7:
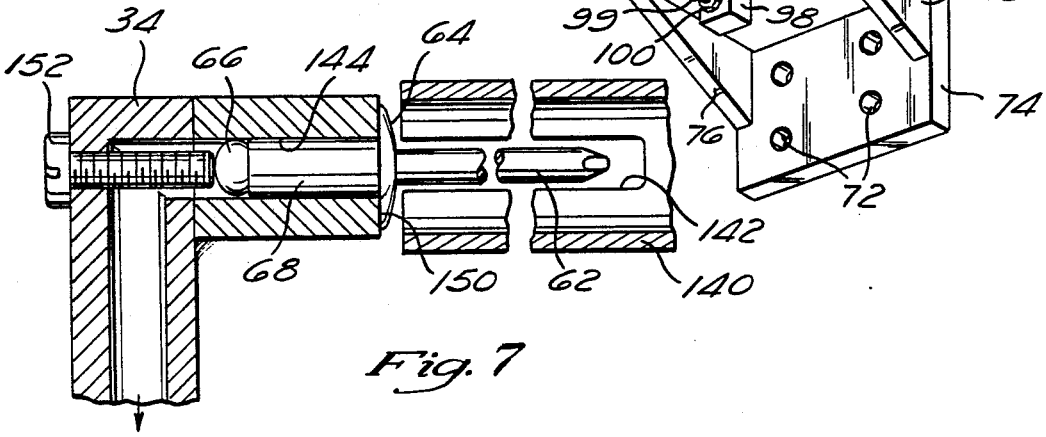
FIG. 7 is a fragmentary cross-sectional view of the pick and place arm of FIG. 4.

The fastener feed tube 32 may be attached to fastener presentment tube 140. As shown in FIGS. 3 and 7, the fastener presentment tube 140 has provided in its forward end a slot 142 of a suitable length and width to allow the fastener to be removed laterally therefrom.

As shown in FIG. 7, propulsion of the fastener 13 through the fastener feed tube 32 and fastener presentment tube 140 causes the fastener to be inserted into the orifice 144 of the pick and place arm 34. Orifice 144 is placed in fluid connection with a pneumatic pump 36, as shown in FIG. 2, by means of suitable vacuum hose 146 and associated fittings. Referring back to FIG. 7, propulsion of the fastener into the pick and place arm orifice 144 causes the fastener flange 64 to abut the face 150 of the pick and place arm 34. In the prior art, this type of transfer of fasteners 13 frequently caused the fastener stem 62 to partially or fully separate from the fastener sleeve 68 and flange 64 portion. That is, the momentum of the fastener stem 62 caused it to partially or fully separate from the fastener sleeve 68 and flange 64 portion, which is restrained by the pick and place arm face 150. Further, if the fastener 13 is received solely by stopping the fastener stem head 66, the fastener sleeve 68 may be partially upset, which may cause fastener 13 to become jammed in the orifice 144.

In order to overcome this defect in the prior art, the pick and place arm 34 is augmented by the addition of a fastener stem stop 152. As shown in FIG. 7, the fastener stem stop 152 may be conveniently constructed from a screw threaded through the end of the pick and place arm 34 distal the fastener 13. The fastener stem stop 152 may be adjusted for the particular size fastener 13 to be installed so that the fastener stem head 66 strikes the fastener stem stop 152 at the same moment that the flange 64 of the fastener sleeve 68 strikes the face 150 of the pick and place arm 34.

Once the fastener 13 is inserted in the pick and place arm orifice 144, the orifice 144 is largely plugged. This plugging results in reduced airflow through the orifice 144. The reduced airflow in turn creates a pressure differential between the airflow with and without a fastener 13 inserted in the pick and place arm orifice 144. This difference in pressure may be conveniently sensed at the pump 36 and may be used to indicate the presence of a fastener 13 in the pick and place arm 34. A pressure transducer switch (not shown) may be mounted adjacent the pump 36 to detect the pressure differential. Mounting the switch adjacent the pump 36 provides the most sensitive, accurate and responsive sensing. However, location of the switch near the pump adds to the weight of the fastener installation module 16. In order to reduce the weight of this module 16, the switch may be moved elsewhere, for example, to the enclosure 60. The signal from the pressure transducer switch (not shown) indicating the presence of a fastener 13 in the pick and place arm 34 may be transmitted through a wire (not shown) routed through the conduit 136.

Figure 4:
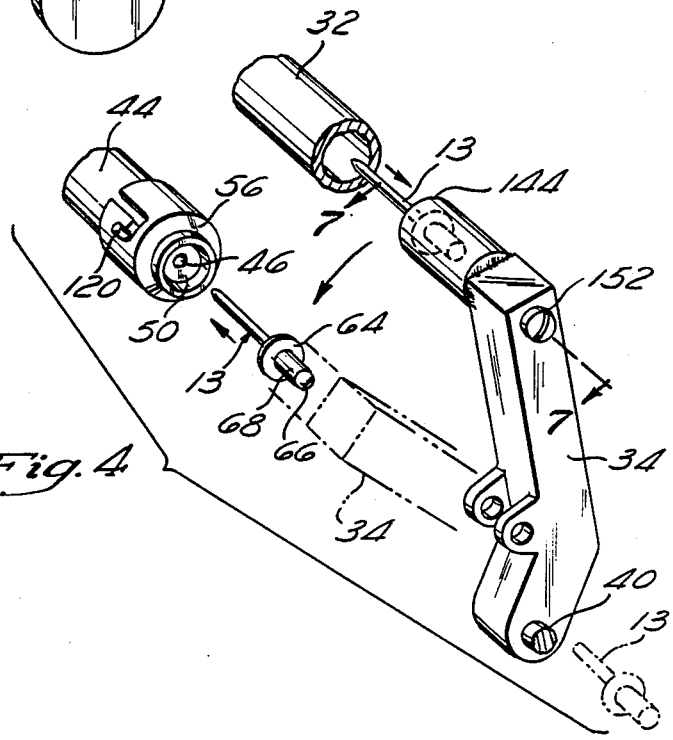
FIG. 4 is a perspective view of the pick and place arm of the fastener installation module of FIG. 3, showing the fastener in the positions which it occupies when it is delivered to the pick and place arm, delivered to the pulling head and delivered to the workpiece.

Referring to FIGS. 3–4, the pick and place arm 34 is rotatably mounted about pick and place arm hinge pin 40. It has been found advantageous to provide between pick and place arm 34 and hinge pin 40 a bearing (not shown). Such a bearing may be of many suitable types, although it has been found convenient to use a needle bearing such as manufactured by Torrington Co., South Bend, Ind. 46634.

The distance between the axis of rotation of pick and place arm hinge pin 40 and the central axis of pick and place arm orifice 144—in which the fastener is received—is equal to the distance between the axis of rotation of the pick and place arm hinge pin 40 and the central axis of the pulling head 44. Thus, rotation of the pick and place arm 34 away from the fastener presentment tube 140 causes alignment of the orifice 144 with the pulling head 44. This rotation of the pick and place arm 34 is effected by the pick and place arm pneumatic cylinder 42. The cylinder 42 is preferably rotatably mounted at the head thereof to a clevis bracket 154. The piston rod 156 of the pick and place arm cylinder 42 is preferably rotatably mounted to the pick and place arm 34 by suitable means, such as, for example, the rod clevis 160.

Referring to FIGS. 3 and 4, extension of the piston rod 156 results in the pick and place arm 34 occupying the position such that the pick and place arm orifice 144 is aligned with the fastener presentment tube 140. Once a fastener is in place in the pick and place arm orifice 144, the piston rod 156 may be retracted by the pick and place arm cylinder 42 so that the pick and place arm 34 occupies a position such that the pick and place arm orifice 144 is aligned with the nosepiece aperture 46 of the pulling head 44. Thus, by reciprocation of the slide-mounted pulling head 44 and rotation of the pick and place arm 34, transfer of a fastener from the pick and place arm 34 to the pulling head 44 may be effected.

The rotational travel of pick and place arm 34 is limited by adjustment of dampeners 162, 163, which are actuated by a tab 164 extending from rod clevis 160. In addition to limiting the travel of piston rod 156, the dampeners 162, 163 act to decelerate the piston rod 156 toward the end of its stroke, providing smooth operation. It has been found convenient to use pneumatic dampeners similar or identical to those used in conjunction with the slide 54, the dampeners 90, 92. Dampeners 162, 163 are preferably adjustably mounted, for example, by threadedly inserting them into threaded mounting brackets 165, which are fastened to the support member 80, and securing them with jam nuts 166. For clarity, both FIGS. 2 and 3 show only one bracket 165 and jam nut 166. The position of the pick and place arm 34 may be indicated by using appropriate detectors 167, 168 in association with the pick and place arm cylinder 42, such as proximity sensors, photoelectric detectors or electro-mechanical sensors. These detectors 167, 168 may be conveniently mounted to brackets 165.

Once the slide 54 has returned to its back position, the successful transfer of the fastener from the pick and place arm 34 to the pulling head 44 is detected by appropriate sensing means, as shown in FIG. 3. Such sensing means may be, for example, a first photoelectric emitter 170 and first photoelectric detector 172.

As shown in FIG. 3, a second photoelectric emitter 174 and a second photoelectric detector 176 may be provided so that the fastener sleeve 68 extending from the pulling head 44 obstructs the photoelectric connection of first photoelectric emitter 170 and first photoelectric detector 172, but does not obstruct the connection of second photoelectric emitter 174 and second photoelectric detector 176. This feature acts to identify fasteners in which the grip length, the length of the sleeve 68, is too long. The power to the first and second photoelectric emitters 170, 174 may be supplied from the control module 20 by means of wires 180, which may be conveniently routed through the conduit 136 along with fastener feed tube 32. Similarly, the signals from first and second photoelectric detectors 172, 176 may be transmitted to the control module 20 by means of wires 182, which may be conveniently routed through the conduit 136. As shown in FIG. 3, photoelectric components 170, 172, 174, 176 may be mounted on a mounting bracket 184. The photoelectric detector mounting bracket 184 may be conveniently extended rearward as shown to provide a cover to protect pulling head 44 from accumulation of debris. Although the embodiment of FIGS. 2–3 shows the detection of the fastener length at the pulling head retracted position, these sensors could be placed elsewhere in the system, such as at the escapement 30 in the feed module 12. The earlier in the system this detection takes place, the earlier a defective fastener will be removed from the cycle.

Although the fastener installation module 16 is shown in FIGS. 1–3, 5–6 without any protective cover or housing, such an addition is preferable. A housing should be provided to prevent foreign debris, dust, falling objects, etc. from entering the module and affecting the numerous precision surfaces, as well as protecting the operator from becoming entangled therein.

ROBOT

The apparatus and method of the present invention may be conveniently used with standard industrial robots or other automated positioning devices. By way of example, a test embodiment of the present invention was utilized in conjunction with an ASEA IRB 60 robot as provided by ASEA Robots, Inc., New Berlin, Wis. 53151. The only requirements for such a robot is that it be able to move the installation module 16 with respect to the workpiece 55 and that it be able to provide a signal to the control module 20 to initiate the installation of a fastener and to accept a signal from the control module 20 inhibiting relative movement between the robot 14 and workpiece 55. It will be understood by one of ordinary skill in the art that the installation module 16 could be stationary and the workpiece 55 could be moved with respect thereto. It will also be understood by one of ordinary skill in the art that the invention, both method and apparatus, could be applied to a powered fastener installation device operated by a human operator.

CONTROL MODULE

The control module 20 receives a signal from the robot 14 commanding installation of the fastener 13 and sends a "busy" signal to the robot 14 inhibiting its movement. Receiving the command from the robot 14 and providing and withdrawing the "busy" signal are the preferred extent of communication between the robot 14 and control module 20. This reduces the complexity of programming the robot 14.

The control module 20 also controls delivery of fasteners 13 from the feed module 12 to the fastener installation module 16 and coordinates delivery of pneumatic and hydraulic pressure to the various pneumatic and hydraulic actuators of the fastener installation module 16. Moreover, the control module 20 receives input from the proximity detectors, photoelectric detectors, accelerometer, vacuum differential detection device, and other sensors and integrates these signals to develop the logic relationships outlined in the following description of the operation. It has been found convenient to use a programmable controller (not shown) to coordinate the logic sequence outlined below. For example, a CTC 2200 controller has been used, as manufactured by Control Technology Corporation, Hopkinton, Mich., 01748. One of ordinary skill in the art will appreciate that this function could be achieved by other controllers and other means, such as programmable logic controllers, microprocessors, minicomputers, hard-wired circuitry, etc.

OPERATION

Figure 14:
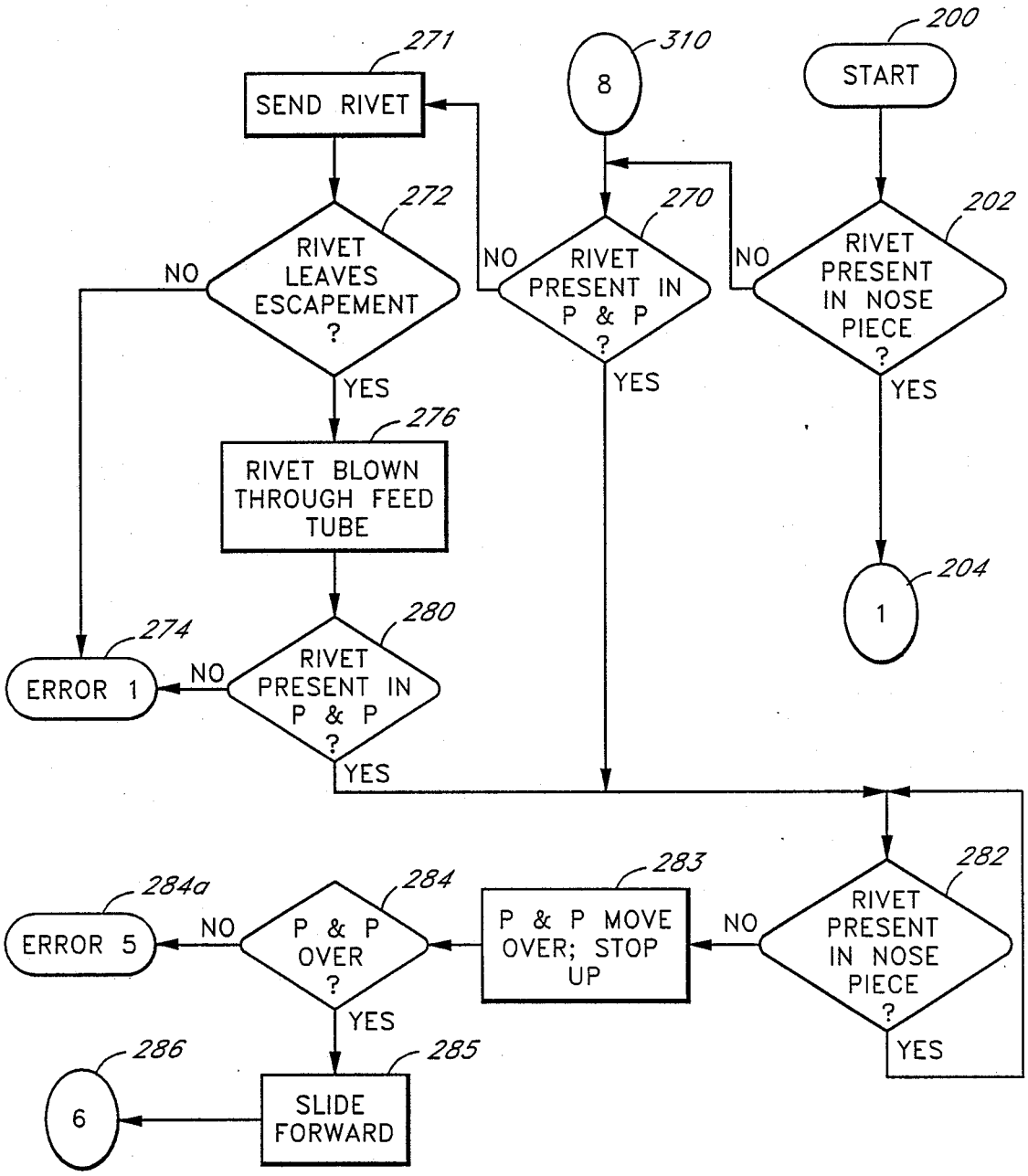
FIGS. 14–20 are a flow chart of an embodiment of the method of the present invention.

Referring to the logic flow chart of FIGS. 14–19, and in particular FIG. 14, initiation of the fastening cycle of the powered fastener installation apparatus 10 and method of the present invention is initiated by receipt of a signal from the robot 14 to initiate the fastener installation cycle. This initiation of the cycle is depicted by the start terminal block 200. Upon receipt of the command signal from the robot 14, control module 20 sends a busy signal to the robot 14, inhibiting any further movement of the robot 14.

As depicted by decision block 202, the next determination is whether there is a fastener 13 present in the pulling head nosepiece 50. This determination is made by the control module 20 sending a signal to first photoelectric emitter 170 and monitoring the response of first photoelectric detector 172. If a fastener 13 is present in nosepiece 50, the fastener sleeve 68 will block the transmission of light from the first photoelectric emitter 170 to the first photoelectric photodetector 172, preventing transmission of a signal from first photoelectric detector 172 to the control module 20. If no fastener 13 is present in the nosepiece 50, the first photoelectric detector 172 will detect the light emitted by the first photoelectric emitter 170 and send a signal to the control module 20.

At this point in the cycle there is a vacuum provided to the interior of pulling head 44 through fastener stem ejection tube 134. This vacuum acts to retain the fastener 13 in the nosepiece 50 regardless of the orientation of robot 14 and the resulting effects of gravity.

Figure 16:
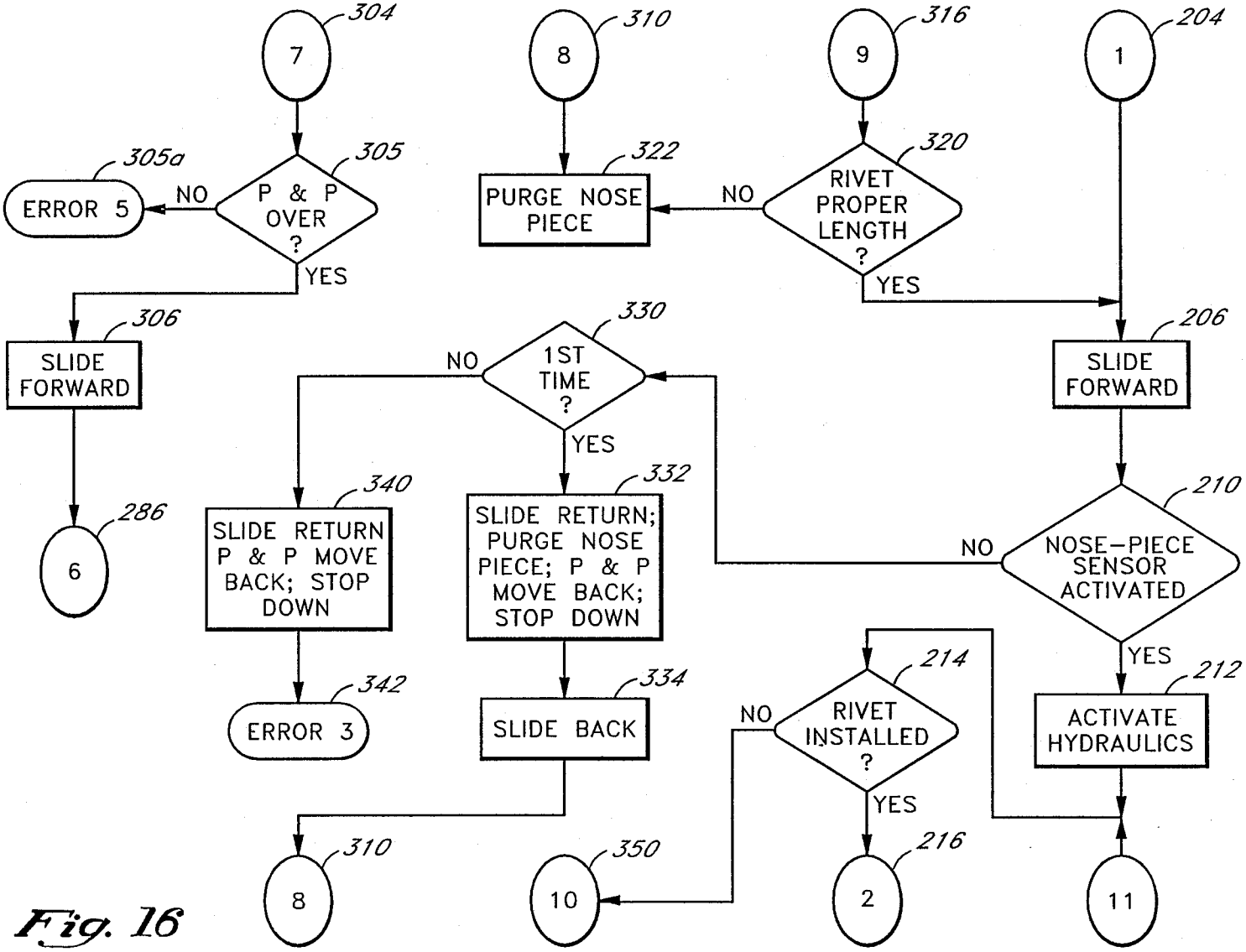

Assuming that there is a fastener 13 present in nosepiece 50, the logic diagram of FIGS. 14 and 16 then proceeds through first connection block 204 to slide forward statement block 206 in FIG. 16. Thus, if a fastener 13 is present in nosepiece 50, the control module 20 will initiate forward motion of the slide 54. Upon the happening of a predetermined event, the control module 20 will determine whether the nosepiece proximity detector 124 has been activated. This is represented by decision block 210. The circuit may be configured to determine whether the nosepiece proximity detector 124 was activated either upon the passage of a predetermined amount of time or upon collar 56 being significantly depressed to excite the proximity detector 124. Preferably, a timer is used to determine whether the nosepiece proximity detector 124 is activated, for example, within a time of 1½ seconds.

The rate of slide travel and the biasing force applied by the pneumatic slide 54 depends on the nature of the workpiece 55. For example, a relatively fragile or painted surface such as a leading or trailing edge of an aircraft wing will require considerably less biasing force and a slower installation rate than a relatively sturdy workpiece such as an automobile floor structure. Certain composite structures have stringent limits as to the amount of force which may be applied. Use of sealants to make the joint fluid-tight requires controlled insertion rates so as not to displace the sealant adversely. The applied force and rate of slide travel is controlled by the air pressure available, the air pressure and volumetric control at the control module 20, and the dampeners 90, 92.

If the nosepiece proximity detector 124 has been activated, it is assumed that the pulling head 44 has contacted the workpiece 55, and successfully placed the fastener 13 into its associated aperture. Accordingly, the logic flow chart shows the statement block 212, which indicates that the control module 20 delivers high pressure hydraulic fluid to the pulling head 44. This high pressure hydraulic fluid biases a conventional piston attached to the compression collet 130, which contacts the pulling jaws 52, resulting in rearward linear motion. As described above, this linear motion causes the jaws 52 of the pulling head 44 to grasp the fastener stem 62 and pull the fastener stem 62 rearward away from the workpiece 55. At the same time, nosepiece 50 urges the fastener flange 64 forward against the workpiece 55.

Following the statement block 212 in the logic flow chart of FIG. 16 is the decision block 214, which represents the determination of whether the fastener 13 has been installed or upset into the workpiece 55. The determination of whether the fastener 13 has been installed has been made in the prior art by determining that the jaws 52 have been pulled for a predetermined time or a predetermined distance or by noting a pressure peak with a pressure transducer in the hydraulic system which is calibrated to sense the pressure required to upset the fastener 13 and deactivate the hydraulics after a slight delay to ensure fastener installation. As discussed above, these methods measure the event of the fastener stem 62 breaking only indirectly. It has been found advantageous to measure the event directly by leaving the hydraulic pressure on until verifying the physical separation of the fastener stem 62 from the installed fastener portion. This direct measurement is accomplished by measuring a sudden change in pressure energy resulting from the physical reactive force from separation or the sound generated from separation. As discussed above, this sudden change in pressure energy may be conveniently detected by an accelerometer 132, or a suitable load cell, microphone, etc.

Figure 17:
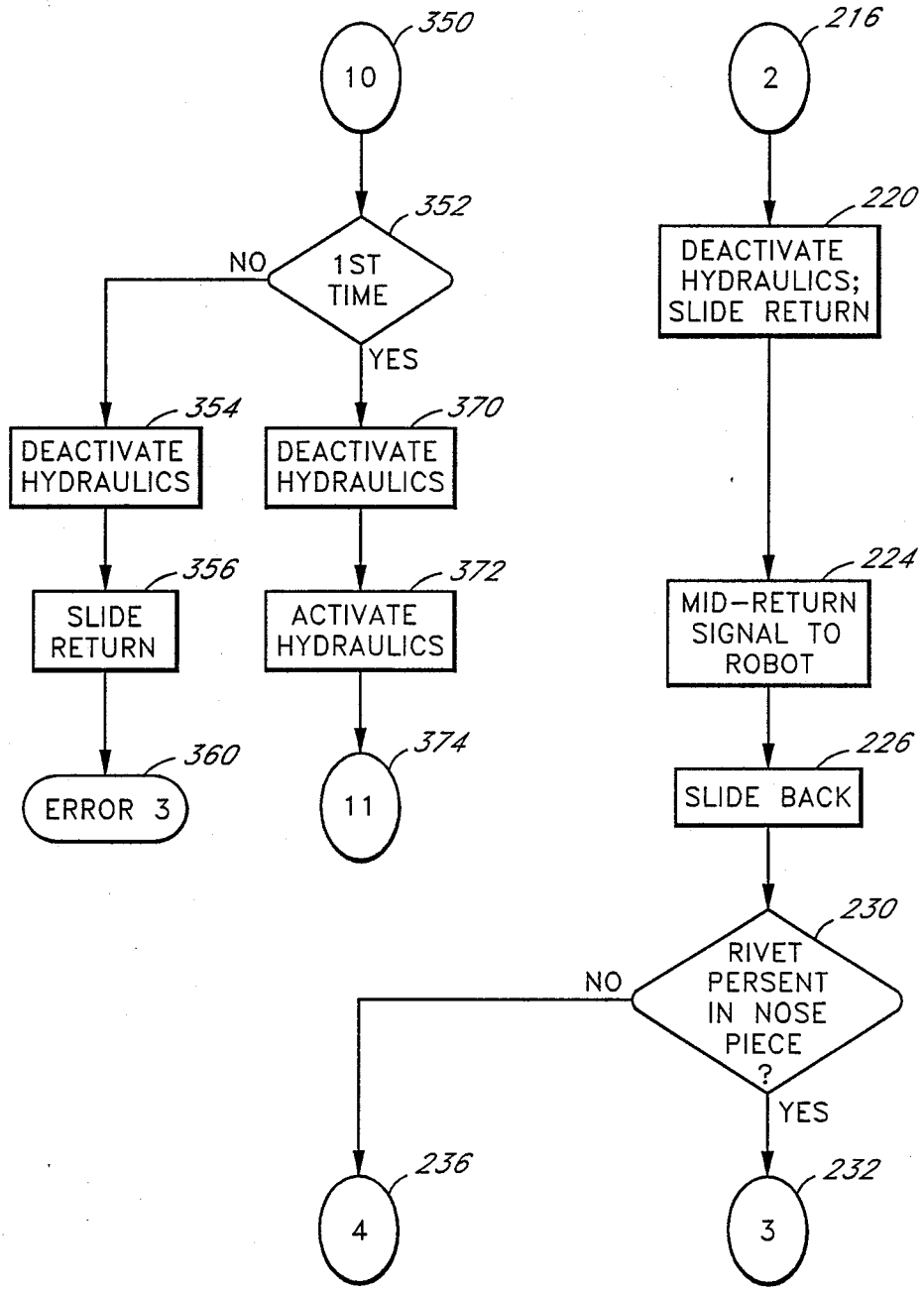

Referring to FIGS. 16 and 17, once the fastener 13 has been verified as installed at decision block 214, the logic flow chart proceeds through second connection block 216 to statement block 220 on FIG. 17. This represents that once the event of fastener installation has been achieved, the hydraulic pressure on the pulling head 44 is deactivated, resulting in termination of the pulling force. Because the hydraulic cylinder (not shown) actuating the pulling head 44 is normally biased to the forward position, this release of hydraulic pressure results in the pulling head jaws 52 moving to their forward position. As they approach the forward position, the jaws 52 are forced apart by the rear of nosepiece 50. The separated fastener stem 138 is then withdrawn by the vacuum through fastener stem ejection tube 134 and removed from the pulling head 44. Although this vacuum may be provided only after the broken fastener stem 138 has been released by the jaws 52, it is deemed advantageous to apply the vacuum as soon as the fastener 13 is transferred from the pick and place arm 34 to the pulling head 44 to prevent the fastener 13 from falling out of the pulling head 44 by force of gravity, as discussed above.

Simultaneous with the release of the hydraulic force biasing the collet 130, the pneumatic slide 54 is returned toward its rearmost position, as indicated by statement block 220. Once the slide has withdrawn to a point where the pulling head 44 is sufficiently clear of the workpiece 55 to allow movement of the robot 14, the control module 20 signals the robot 14 that the robot 14 is free to begin movement to the next position or workpiece 55. Thus, the "electronic hand shake" between the control module 20 and robot 14 is ended as soon as the pulling head 44 has withdrawn from the workpiece 55 by a predetermined distance. This termination of the electronic handshake is depicted in the logic flow chart of FIG. 17 by the midreturn signal to robot statement block 224.

Once the slide has returned to its rearmost position, indicated by slide back statement block 226, the first photoelectric emitter and detector 170, 172 are utilized to determine whether a fastener 13 is present in the nosepiece 50, as depicted by decision block 230. If a fastener is present in the nosepiece, the cycle is completed as indicated by third connection block 232 in FIGS. 17 and 19 and cycle complete terminal block 234 in FIG. 19.

Figure 18:
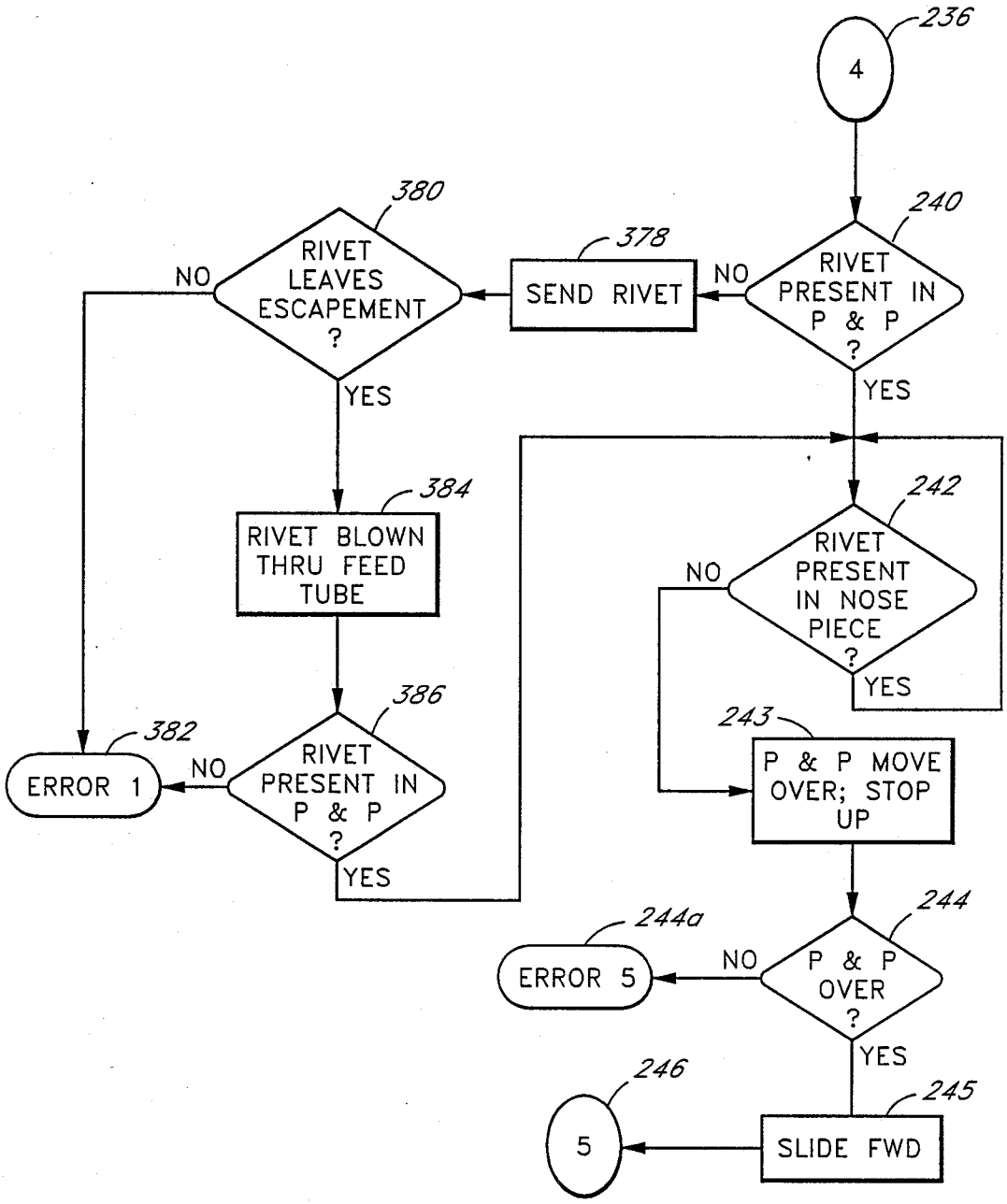

However, because a fastener 13 has just been installed, the nosepiece 50 will never have a fastener 13 present. Thus, referring to FIG. 17, the decision at decision block 230 will always be no, leading to fourth connection block 236. Referring to FIG. 18, depending from fourth connection block 236 is decision block 240. This signifies that the control module 20 samples the vacuum through the pick and place arm orifice 144, vacuum hose 146, pump 36, and the pressure transducer switch (not shown) to determine whether a fastener 13 is present in the pick and place arm orifice 144. If a fastener 13 is present, the control module 20 redetermines whether a fastener 13 is present in nosepiece 50. This determination is signified by decision block 242. As a practical matter, the decision will always be no, because the same negative determination was just made at decision block 230 as depicted in FIG. 17. Thus, assuming that no fastener 13 is present in nosepiece 50, the pick and place arm 34, which has been determined to contain a fastener 13 in decision block 240, is rotated about hinge pin 40 by pneumatic cylinder 42 to present a fastener 13 in alignment with pulling head 44. Simultaneously, the stop 103 is raised. These actions are reflected in statement block 243. Next the decision is made whether the pick and place arm 34 is aligned with the nosepiece aperture 46, such as by detector 167, at decision block 244. If it is not aligned when the timer elapses, an error 5 is displayed, as indicated by terminal block **244*a*. If it is aligned, the control module 20 initiates forward movement of pneumatic slide 54. These actions are depicted by statement block 245. The pneumatic slide 54 will travel forward until it is obstructed by stop 103. If the collar 56 has been depressed by contact with the pick and place arm face 150, as depicted by the fifth connection block 246 in FIGS. 18–19 and in decision block 248, a number of operations are performed, as depicted by statement block 252 in FIG. 19. First, the vacuum pressure in the pick and place arm 34 is momentarily removed and replaced by a positive pressure to bias the fastener 13 outward, away from pick and place arm face 150, thereby pneumatically biasing the fastener 13. Second, the pick and place arm is moved to its back position. Third, the pneumatic pressure urging slide 54 forward is reversed to return the slide 54 to its rear position. Fourth, the stop 103** is lowered.

Once the slide 54 is back to its rearmost position, as indicated by statement block 254, the control module 20 seeks to determine whether a fastener 13 is present in the nosepiece 50, once again using the first photoelectric emitter and detector 170, 172. This examination is reflected in decision block 256 in FIG. 19.

If indeed a fastener 13 is present in nosepiece 50, the control module 20 attempts to determine if the fastener 13 present in nosepiece 50 is of the proper grip length. This examination is indicated by decision block 260 in FIG. 19. The control module 20 determines whether the fastener 13 has the proper grip length by sending a signal to the second photoelectric emitter 174. If the fastener 13 has an excessively long grip length, the fastener sleeve 68 or fastener stem head 66 will obstruct transmission of light from the second photoelectric emitter 174 to the second photoelectric detector 176. Thus, an improperly long fastener will preclude transmission of a signal from second photoelectric detector 176 back to control module 20. On the other hand, if the fastener 13 has a proper grip length, the line of sight between second photoelectric emitter 174 and second photoelectric detector 176 will remain unobstructed and the signal supplied to second photoelectric emitter 174 will cause emission of a light beam which will be detected by second photoelectric detector 176, resulting in a signal being transmitted to control module 20. Even if a fastener 13 is present in the nosepiece 50, the first photoelectric emitter and detector 170, 772 will not indicate its presence unless its grip length is sufficient to obstruct the path therebetween. So the decision block 256 also represents that the grip length of the fastener 13 is checked to see if it is too short. Another detector could be used to check for presence of the fastener 13 by focusing on the fastener stem 62 instead of the sleeve 68 and head 66. If the fastener 13 is of the proper grip length the cycle is complete as indicated by cycle complete terminal block 234.

It will be understood by one of ordinary skill in the art that the fastener length determination of decision block 260 could be performed in other locations in the apparatus and method. For example, the fastener length could be checked at or before the feed module escapement 30 rather than in the fastener installation module 16. Indeed, it is preferred that the fastener length be checked as early in the system as possible, preferably in the feed module 16.

The foregoing description of the fastener installation cycle assumes that the cycle has proceeded without encountering any error conditions. The apparatus and method of the present invention include means for detecting and resolving errors in the fastener installation cycle. These apparatus and methods will be described below.

Referring to FIG. 14, if the first photoelectric emitter 170 and detector 172 indicate that there is no fastener 13 present in the nosepiece 50, the answer to decision block 202 will be no and the logic diagram of FIG. 14 will proceed to the decision block 270, which represents the determination of whether a fastener 13 is present in the pick and place arm 34. If no fastener 13 is present in the pick and place arm 34, the answer to decision block 270 will be no and the logic flow diagram of FIG. 14 will proceed to statement block 271. This statement block signifies a command to the escapement 30 to dispatch a single fastener 13 through the feed tube 32 to the pick and place arm 34. Decision block 272 represents that the control module 20 determines when a fastener 13 leaves the escapement 30 of the feed module 12. If no fastener 13 leaves the escapement 30 within a predetermined amount of time, the logic flow diagram of FIG. 14 advances to error 1 termination block 274, indicating that the feed module 12 is unable to transfer a fastener 13 from the escapement 30.

If, on the other hand, a fastener 13 has left the escapement 30, a fastener 13 is blown through fastener feed tube 32 to the pick and place arm 34. This action is reflected by statement block 276. After a predetermined time, the control module 20 samples the vacuum in the pick and place arm 34 to determine whether a fastener 13 is present therein. If no fastener 13 is present in the pick and place arm 34 at this point, the answer to decision block 280 is no and the logic flow diagram of FIG. 14 proceeds to error 1 terminal block 274. This error message indicates that, although a fastener 13 has left the escapement 30, no fastener 13 has been delivered to the pick and place arm 34. This condition may be due to a number of problems, commonly including a kinked fastener feed tube 32, debris in the system, multiple fasteners 13 jammed within the feed tube 32, etc. One of ordinary skill in the art will recognize that separate error messages could be given following a "no" decision on decision blocks 272, 280 and that they have been combined for convenience.

If the control module 20 senses that a fastener 13 is present in the pick and place arm 34 by virtue of the vacuum present therein, the answer to decision block 280 is yes and the logic flow diagram of FIG. 14 proceeds to decision block 282. At this point, the logic flow diagram proceeds as if a fastener 13 had been present in the pick and place arm 34 at decision block 270.

The control module 20 activates the first photoelectric emitter and detector 170, 172 to determine whether a fastener 13 is present in the nosepiece 50. Because this determination is made after the same negative determination in decision block 202, it will always be negative. Thus, the logic flow diagram of FIG. 14 proceeds to statement block 283. The pick and place arm 34 is moved over from its back position. Simultaneously the pneumatic stop cylinder 102 is extended to raise the stop 103 to impede progress of the slide 54 and stop the slide 54 at the position where the pulling head nosepiece is adjacent the fastener flange 64 of the fastener 13 presented by the pick and place arm 34. As statement block 284 indicates, the detector 167 determines whether the pick and place arm 34 has been aligned with the pulling head. If not, as indicated by terminal block 284*a*, an error 5 indication is given. This indicates that the pick and place arm 34 is jammed.

Upon verification by detector 167 that the pick and place arm is aligned with the pulling head 44, the control module 20 initiates forward movement of the pneumatic slide 54, thereby drawing the pulling head 44 toward the fastener 13 offered by the pick and place arm 34. Referring to the sixth connection block 286 in FIGS. 14–15 and FIG. 15 in particular, if the pick and place arm 34 is in its proper position, the collar 56 will be depressed, thereby exciting the proximity detector 124. The control module 20 looks for the signal from the proximity detector 124, as represented by decision block 290. If the proximity detector 124 does not signal the control module 20, the answer to decision block 290 is no and the logic flow diagram of FIG. 15 proceeds to decision block 292. This procedure enables the control module 20 to attempt to load the pulling head 44 a second time. If the nosepiece detector 124 fails to be excited upon the second attempt, the answer to decision block 292 is no and the control module 20 causes the pneumatic slide 54 to return to its rearmost position, the pick and place arm 34 to return to its back position and the stop cylinder 102 to lower the stop 103, as indicated by statement block 294, and indicate a second error message, as indicated by the error 2 terminal block 296. The error 2 message indicates that notwithstanding the presence of a fastener 13 in the pick and place arm 34, the fastener installation module 16 is unable to effect successful transfer of the fastener 13 to the pulling head nosepiece 50.

Figure 15:
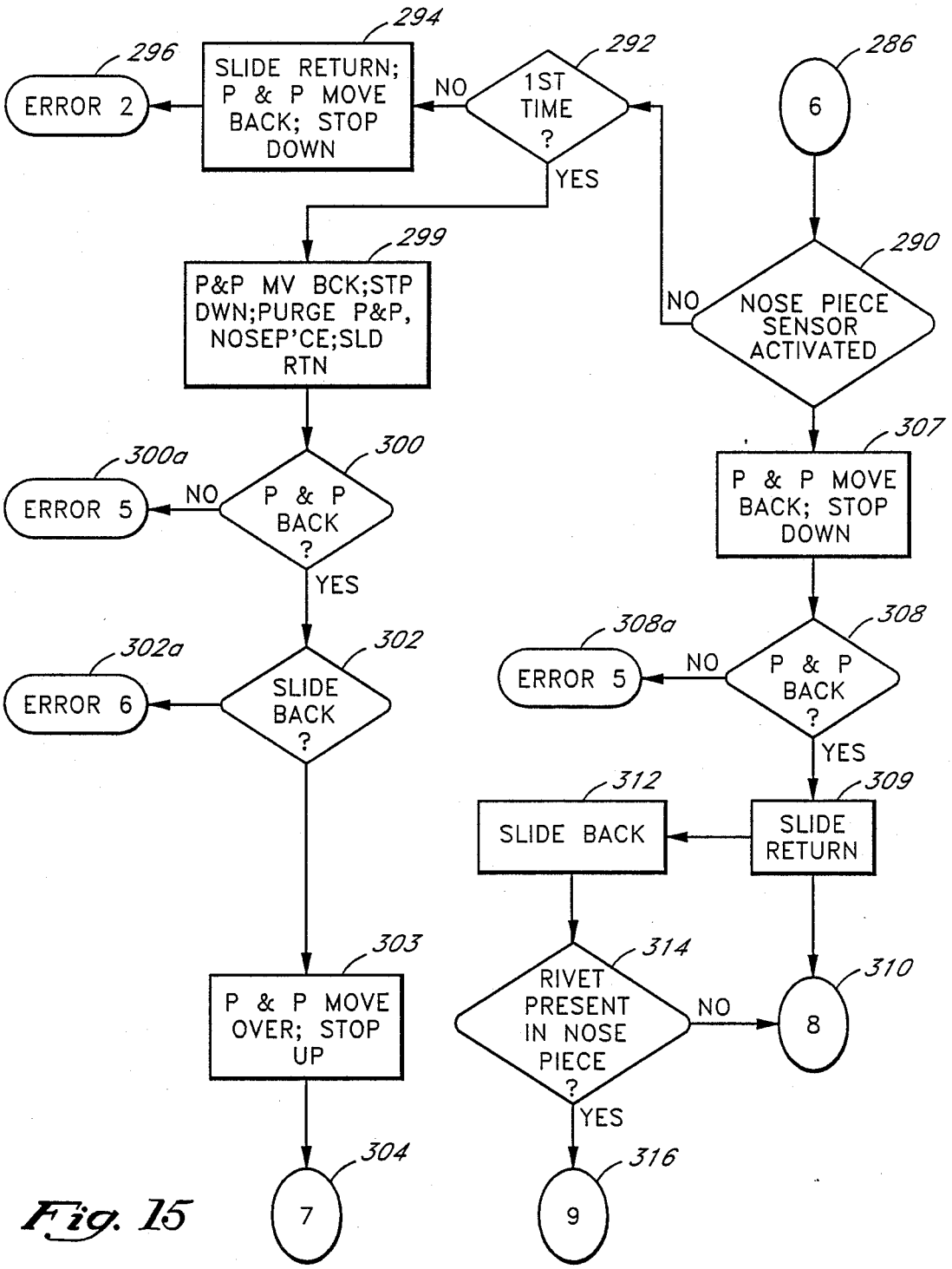

If, however, the nosepiece detector 124 has failed to be excited upon the first attempt, the answer to decision block 292 is yes and the logic flow diagram of FIG. 15 proceeds to statement block 299. As indicated, the pick and place arm 34 is moved back and the stop 103 is dropped down. The vacuum in the pick and place arm 34 and pulling head 44 is replaced with a positive pressure to effect a purge. Also, the slide 54 is returned toward its back position. As reflected in decision block 300, the control module 20 checks via detector 168 whether the pick and place arm 34 has returned. If it has not returned, an error 5 message is displayed, as indicated by statement block 300*a*. If the pick and place arm 34 has returned, the logic diagram proceeds to decision block 302, which indicates that the control module 20 checks to see if the slide 54 has returned to its back position, by back limit switch 88. If it has not, as indicated by terminal block 302*a*, an error 6 message is displayed, which reflects that the slide 54 has been obstructed. If it has, the logic diagram of FIG. 15 proceeds to statement block 303.

The control module 20 directs retraction of the pick and place arm cylinder 42, thereby moving the pick and place arm 34 over into alignment with the nosepiece 50, and raises the stop 103, as depicted by statement block 303. As shown in decision block 305 in FIG. 16, via seventh connection block 304, the determination is made whether the pick and place arm 34 has reached its over position, aligned with the pulling head. If it has not done so within a certain amount of time, as indicated by terminal block 305*a*, an error 5 indication is given. If it does, the control module 20 causes forward movement of the slide 54 toward the stop 103. This activity is depicted by statement block 306. Simultaneously, control module 20 starts a timer to initiate determination of whether the nosepiece sensor 124 has been activated, as depicted by sixth connection blocks 286 and decision block 290 in FIG. 15.

Once the nosepiece detector 124 has been excited upon abutment of the pulling head collar 56 and pick and place arm 34, the answer to decision block 290 is yes, and the logic flow chart of FIG. 15 proceeds to statement block 307. Upon ascertaining the presence of a fastener 13 in nosepiece 50, the control module 20 momentarily replaces the vacuum in the pick and place arm 34 with a positive pressure, starts a timer, causes the pick and place arm 34 to return to its back position and causes retraction of the stop 103, as indicated by statement block 307. Once again, the pick and place arm is checked to see whether it has returned, in decision block 308. If not, the control module 20 signals an error 5, as evidenced by terminal block 308*a*. If it has, the slide 54 is returned toward its back position, as indicated by statement block 309. Initiation of the slide's return in turn initiates start of the fastener feed cycle as indicated by the connection between statement block 309 and the eighth connection block 310 on FIGS. 14 and 15. This feature enables the initiation of a new feed cycle as soon as a fastener 13 has been removed from the pick and place arm 34, thereby minimizing the cycle time required for feeding fasteners from the feed module 12 to the pick and place arm 34. That is, the time required to feed a fastener 13 from the feed module 12 to the pick and place arm 34 is internalized within the remainder of the cycle.

In addition to initiating a new fastener feed cycle, return of slide 54 continues until the back limit switch 88 indicates that the slide 54 has reached its rearmost position, as depicted by statement block 312. Once the slide 54 has reached its rearmost position, the control module 20 checks to determine whether there is a fastener 13 present in the nosepiece 50, as depicted in decision block 314. If no fastener 13 is present, the answer to decision block 314 is no and the control module initiates another cycle of reloading the fastener 13 from the pick and place arm 34, as depicted by the eighth connection block 310 in FIGS. 14 and 15.

If, on the other hand, a fastener 13 is present in pulling head nosepiece 50, the answer to decision block is yes and the logic flow diagram of FIGS. 15 and 16 proceeds through the ninth connection block 316 to decision block 320 in FIG. 16. Thus, if a fastener 13 is present in nosepiece 50, the control module 20 initiates determination of whether the fastener 13 has the proper grip length. As discussed above, this determination is made by second photoelectric emitter and detector 174, 176. If the answer to decision block 320 is no, because the fastener 13 has an improper grip length, the control module 20 replaces the vacuum within the pulling head 44 with a positive pressure, thereby purging the nosepiece 50, as indicated by statement block 322. Once the nosepiece 50 is purged of the fastener 13 having an improper grip length, the control module 20 returns to the cycle transferring the fastener 13 from the pick and place arm 34 to the pulling head 44, as depicted by the eighth connection block 310 in FIGS. 14 and 16. As also discussed above, the fastener length determination of decision block 320 could conveniently be made elsewhere in the apparatus and method.

Referring to FIG. 16, if, however, the fastener 13 in the pulling head 44 is of the proper grip length, the control module 20 directs that the slide 54 move forward from its rearmost position toward the workpiece 55 as depicted by statement block 206. If the nosepiece detector 124 is not activated within a predetermined amount of time, as indicated by decision block 210, the control module will determine whether the failure to activate the nosepiece 124 is the first occurrence, as depicted by decision block 330. If the failure to activate the nosepiece detector 124 is on the first occurrence, the answer to decision block 330 is yes, and the control module 20 directs the slide 54 to return to its rearmost position directs the pick and place arm 34 to rotate back, directs the stop 103 to drop, while also directing that the vacuum within pulling head 44 be replaced by a positive pressure, thereby purging nosepiece 50. These actions are reflected by statement block 332. Once the slide 54 returns to its rearmost position, as detected by back limit switch 88 and indicated by statement block 334, the control module 20 initiates a new cycle transferring a fastener 13 from the pick and place arm 34 to the pulling head nosepiece 50, as indicated by the eighth connection block 310 on FIGS. 14 and 16.

If, however, the failure to activate the nosepiece detector 124 upon forward movement of the slide 54 is after the first occurrence, the answer to decision block 330 is no, and the control module 20 directs the return of slide 54 pick and place arm 34 and stop 103, as indicated by statement block 340, and indicates an error as depicted by error 3 terminal block 342. The error 3 message indicates the unsuccessful installation of a fastener 13 in a workpiece 55 after two attempts. This error indication may mean that the end of the fastener 13 has not been placed into the aperture within the workpiece 55, that the workpiece 55 is not in its proper position, the robot 14 has not positioned within acceptable limits, the workpiece aperture is undersized or absent, or that the forward motion of the slide 54 has been inhibited.

If the nosepiece detector 124 is activated upon moving the slide 54 forward, the control module 20 activates the hydraulics operating the pulling head 44 as explained above and as depicted by statement block 212. However, if the accelerometer 132 does not detect the event of the fastener stem 62 breaking within the predetermined time interval, the answer to decision block 214 is no. In this event, the logic flow diagram of FIGS. 16 and 17 proceeds to the tenth connection block 350 and decision block 352. If the failure to install the fastener 13 is the first occurrence thereof, the control module 20 will attempt to re-cycle the hydraulics of the pulling head 44. If, however, the failure to install the fastener 13 into the workpiece 55 occurs after the first time, the answer to decision block 352 is no. As depicted by statement blocks 354, 356 and terminal block 360, upon failure to install the fastener 13 into the workpiece 55 the second time, the control module 20 will deactivate the hydraulics of the pulling head 44, wait a predetermined interval of time to allow the jaws 52 to open, thereby freeing the fastener stem 62, return the slide 54 to its rearmost position, and indicate an error 3. This designation is a likely indication that the jaws 52 failed to grip the fastener stem 62 or that the fastener 13 has not upset.

An important feature of this invention, heretofore unappreciated in the prior art, is that upon failure to properly install a fastener 13 into a workpiece 55, the powered fastener installation apparatus 10 will release the fastener 13 before withdrawing from the workpiece 55. This release of the fastener 13 prevents pulling a partially upset fastener 13 through the aperture in the workpiece 55. That occurrence will potentially damage what can be a very expensive workpiece 55.

If the failure to install the fastener 13 into the workpiece 55 is the first occurrence, the answer to decision block 352 is yes and the logic flow path of Figure 17 proceeds to statement blocks 370, 372. That is, after the first occurrence of failure to properly install a fastener 13 into a workpiece 55, the control module 20 deactivates the hydraulics within the pulling head 44, allowing the jaws 52 to expand and return to their forward position. After a suitable time delay to allow the jaws 52 to return and open, the control module 20 reactivates the hydraulics, causing the jaws to clamp about the fastener stem 62 and pull the fastener stem 62 rearward away from the workpiece 55. As shown by the eleventh connection block 374 on FIGS. 16 and 17, reactivation of the hydraulics after the first failure to install a fastener 13 returns to the logic flow path at the decision block 214 in FIG. 16, which represents the determination of whether the fastener 13 has been properly installed in the workpiece 55.

Once the fastener 13 has been successfully installed, the fastener installation apparatus 10 proceeds through logic steps 216, 220, 224, 226, 230, 236, 240 of FIGS. 16–18, until the control module 20 determines whether a fastener 13 is present in the pick and place arm 34. If no fastener 13 is present in the pick and place arm 34, the answer to decision block 240 in FIG. 18 is no, and the control module 20 directs that the escapement 30 dispatch a fastener 13 through the fastener feed tube 32 to the pick and place arm 34, as depicted by statement block 378. The escapement 30 is monitored by suitable means to determine whether it successfully dispatches a fastener 13 in response to this command within a predetermined time period. If no fastener 13 is dispatched, the answer to decision block 380 is no and the control module 20 displays an error 1 indication as depicted by terminal block 382. As discussed above, this error signal indicates that the escapement 30 is unable to deliver a fastener 13 to the fastener feed tube 32.

If, however, the escapement 30 successfully dispatches a fastener 13 to the fastener feed tube 32, the answer to decision block 380 is yes and the logic flow diagram of FIG. 18 proceeds to statement block 384. This statement block represents the indication that the fastener 13 has been blown through the feed tube 32. Upon successful delivery through feed tube 32 and fastener presentment tube 140, the fastener 13 arrives in the pick and place arm 34. If, however, no fastener arrives in pick and place arm 34 within a predetermined amount of time, the answer to decision block 386 is no, which answer will also cause display of an error 1 signal. This error 1 signal is, however, due to obstruction of the fastener 13 in the fastener feed tube 32, such as by a kinked tube, or obstruction of the fastener presentment tube 140 such as by accumulation of debris.

Figure 19:
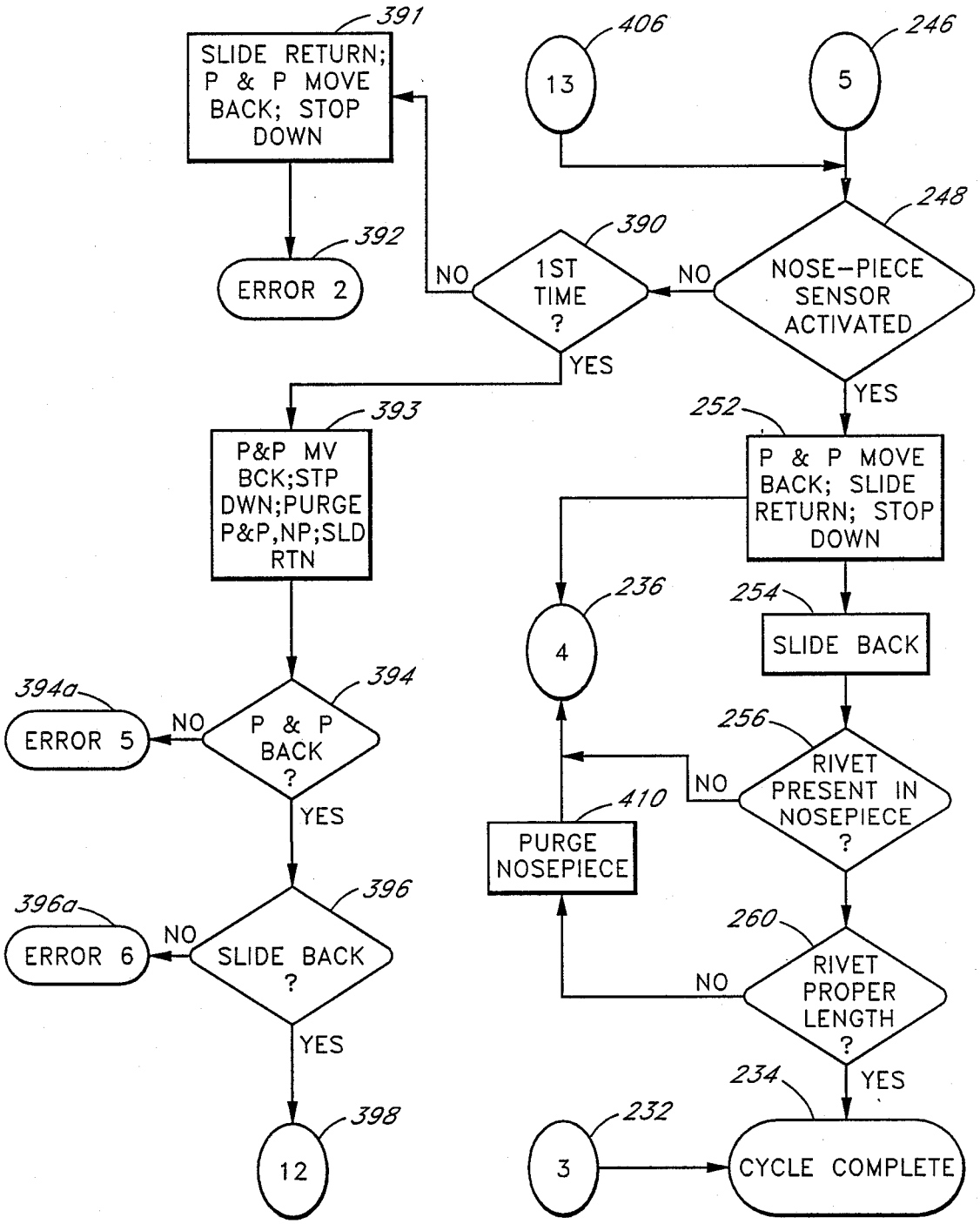
Figure 20:
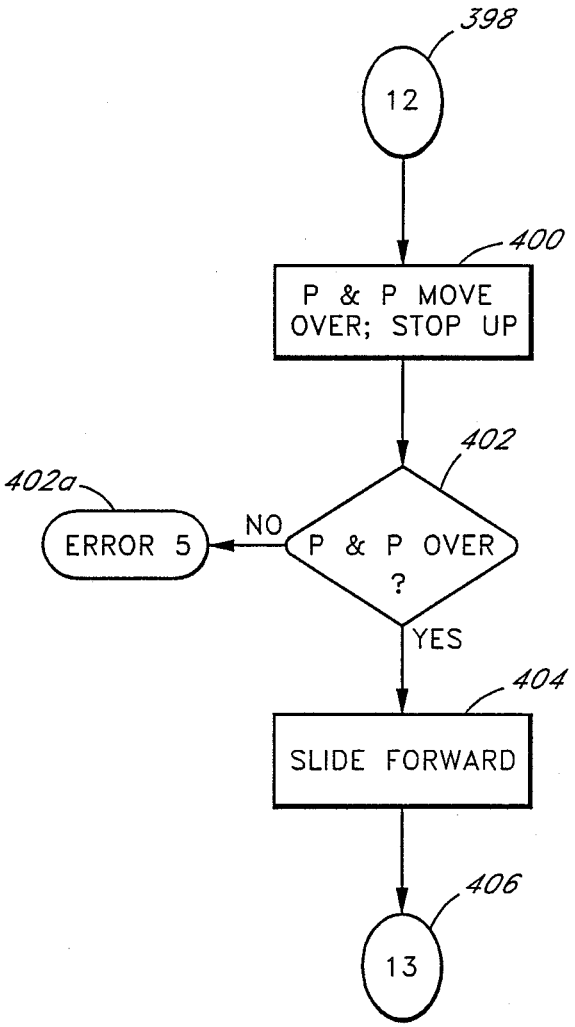

If a fastener 13 is successfully received by the pick and place arm 34, the logic flow chart of FIG. 18 returns to the decision block 242, at which the control module 20 determines whether a fastener 13 is present in the nosepiece 50. As discussed above, because the pulling head 44 has just successfully installed a fastener 13 into the workpiece 55, the answer to decision block 242 is always no, and the logic flow chart of FIGS. 18–19 proceeds through logic steps 243–246 to decision block 248, at which the control module 20 determines whether the nosepiece sensor 124 has been activated by the pick and place arm face 150. If the nosepiece sensor 124 has not been activated, the answer to decision block 248 in FIG. 19 is no and the control module 20 determines, at decision block 390, whether the failure of the nosepiece 124 to encounter the pick and place arm face 150 is the first occurrence. If it is not the first occurrence, the control module 20 causes the slide 54, pick and place arm 34, and stop 103 to return, and signals an error 2, as depicted by statement block 391 and terminal block 392. If it is the first occurrence, the answer to decision block 390 is yes and the logic flow diagram of FIG. 19 proceeds to statement block 393, at which the control module 20 directs the return of the pick and place arm 34, slide 54, and the stop 103. The control module 20 also directs the momentary replacement of the vacuum in the pick and place arm 34 and pulling head 44 with a positive pressure to effect a purge. If the pick and place arm 34 does not return within a predetermined period of time, an error 5 is signaled, as depicted in decision block 394 and terminal block **394*a*. If, on the other hand, the arm 34 does return, the control module 20 checks at back limit switch 88 to see whether the slide has returned, as indicated by decision block 396. If it has not, an error 6 is signaled, as depicted by terminal block 396*a*. Once the slide 54 has returned to its rearward position, the control module 20 directs the pick and place arm 34 over into alignment with the pulling head 44 and directs the stop 103 up, as indicated by the twelfth connection block 398 of FIGS. 19 and 20 and decision block 400 of FIG. 20. If the pick and place arm does not move into alignment with the pulling head 44, as determined by sensor 167, within a predetermined amount of time, an error 5 condition is signaled, as indicated by decision block 402 and terminal block 402*a*. If it does, the control module 20 directs the slide 54 to move forward, as indicated in block 404. The control module 20 determines whether the nosepiece detector 124 has been activated within the predetermined time at decision block 248, as interconnected by the thirteenth connection block 406**.

Assuming that the nosepiece sensor 124 was activated by the pick and place arm face 150 before the time elapsed, the answer to decision block 248 is yes, and the control module 20 directs the pick and place arm 34 and slide 54 to return from their engaged position and directs withdrawal of the stop 103, as depicted by statement block 252 in FIG. 19. Initiation of this return motion of the pick and place arm 34 and slide 54 is accompanied by initiation of the transfer cycle of the fastener 13 between the pick and place arm 34 and the pulling head nosepiece 50, via the fourth connection block 236 in FIGS. 18 and 19.

Similarly, absence of a fastener 13 in the nosepiece 50 at decision block 256 causes the control module 20 to reinitiate the transfer cycle of the fastener 13 between the pick and place arm 34 and the pulling head nosepiece 50. Further, determination that the fastener 13 in the pulling head nosepiece 50 has an excessive grip length, at decision block 260, results in purging of the nosepiece 50, as indicated in statement block 410, and reinitiation of the cycle transferring a fastener 13 from the pick and place arm 34 to the pulling head nosepiece 50, as indicated by the fourth connection block 236.

Figure 21:
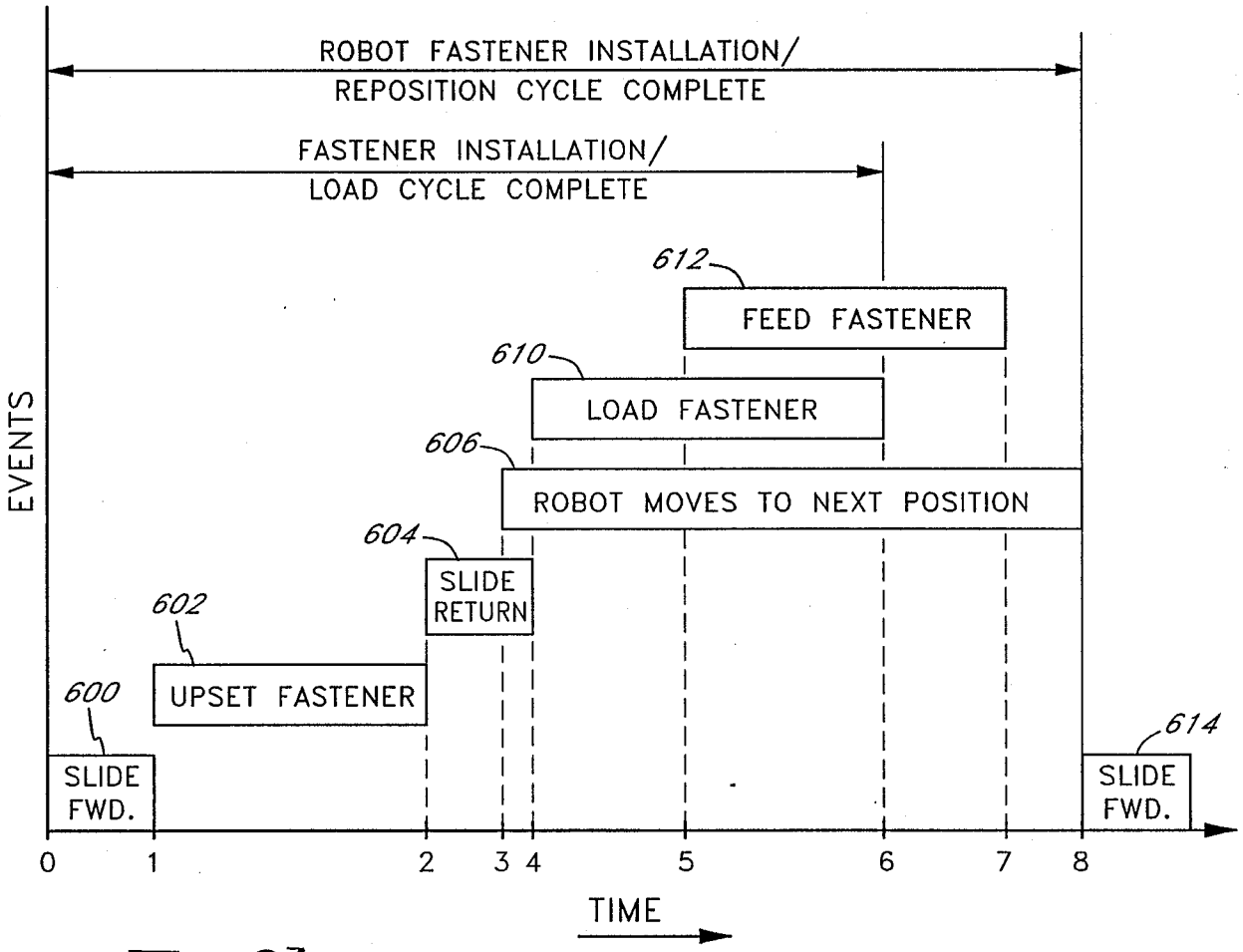
FIG. 21 is a schematic representation of the individual component events of the fastener installation cycle of the present invention with respect to time.

FIG. 21 is a schematic representation of the sequence of events over time of the fastener installation cycle of the present invention. The horizontal axis represents time and the vertical axis represents the events. At time 0 the robot 14 signals the control module 20 to initiate the fastener installation cycle. At time 1 the slide 54 has moved forward to insert the fastener 13 in the workpiece, as depicted by block 600. At time 2, the pulling head 44 has upset the fastener 13, which event has been detected by the accelerometer 132 and is depicted by block 602. Also at time 2, the slide 54 will start to retract toward its back position, as depicted by block 604. Before the slide 54 has retracted all the way, the control module 20 signals the robot 14 that it is free to move, and at time 3 the robot 14 begins moving to its next position, as depicted by block 606. The control module 20 frees the robot 14 to move as soon as possible, thereby overlapping the slide return component and the robot moving component, which saves overall cycle time. At time 4, once the slide 54 has retracted to its back position and the absence of a fastener 13 is detected, a load cycle—transferring the fastener 13 from the pick and place arm 34 to the pulling head 44—is initiated, as depicted by block 610. At time 5, once the pick and place arm 34 returns to its back position and the absence of a fastener is detected therein, a feed rivet cycle—delivering a fastener 13 from the feed module 12 to the pick and place arm 34—is initiated, as depicted by block 612. At time 6, a fastener 13 has been transferred from the pick and place arm 34 to the pulling head 44 and the slide 54 has retracted to its back position. The overlap between the feed and load components—the time between times 5 and 6—is due to the difference in the time it takes to return the pick and place arm 34 and the slide 54. This difference is due to the greater inertia of the slide and other characteristics of its construction. The overlap speeds up the overall cycle in that the feed portion is assured of being completed before the next load portion can begin. At time 7, a fastener 13 has been delivered from the feed module 12 to the pick and place arm 34. Finally, at time 8, the robot 14 has moved to its next position, completing the robot fastener installation cycle. Once the cycle is complete, the robot 14 may initiate another cycle, beginning with block 614.

The cycle of FIG. 21 is a typical cycle. The duration of the individual components will, of course, vary in response to a number of factors. The speed with which any particular pneumatic-activated component of the cycle occurs depends on the velocity and pressure of the air supply, the length of motion, and the adjustment of the dampeners and air supply valves. In the typical cycle shown for a ¼ nail rivet, time 1 occurs at 0.25 seconds, time 2 occurs at 1.125 seconds, time 3 occurs at 1.4 seconds, time 4 occurs at 1.5 seconds, time 5 occurs at 1.9 seconds, time 6 occurs at 2.7 seconds, time 7 occurs at 3.2 seconds, and time 8 occurs at 3.6 seconds. It will be appreciated that the fastener installation module 16 and its installation/load cycle, which terminates at time 6, does not slow down the robot fastener installation cycle, which ends at time 8. Only if the robot 14 is sped up considerably in its moving to the next position will the robot 14 have to wait for the completion of the fastener installation/load cycle. It will also be appreciated that the fastener feeding is accomplished totally internal to the other tasks and does not affect the total cycle time.

In addition to the method of the present invention reducing the total cycle time by overlapping cycle components, the apparatus of the present invention facilitates faster accomplishment of individual cycle components. The pick and place arm 34 and the pulling head 44 each undergo only reciprocating motion of a single sense. That is, the pick and place arm 34 only rotates back and forth in a single plane and the slide-mounted pulling head 44 only reciprocates linearly in a single line perpendicular to the plane of motion of the pick and place arm 34. The avoidance of complex motion in transferring and upsetting the fastener 13 allows for simplicity and durability of mechanism and speed of operation.

The additional speed is achieved without a reduction in tolerance. The slide-mounted pulling head arrangement provides excellent axial tolerance for errors in robot or workpiece placement. Similarly, the vacuum nosepiece arrangement allows for lateral and angular tolerance of errors, in the robot placement or workpiece aperture location or angle.

ALTERNATE EMBODIMENT

The alternate embodiment described below in conjunction with FIGS. 10–13 has many components in common with the preferred embodiment already discussed. Where components are common or equivalent, they will be numbered with like numerals, and the alternate embodiments will be indicated by a prime designation.

Referring to FIG. 10, the fastener installation module 16' of the alternate embodiment is constructed to minimize length and weight. These criteria may be particularly important in any given installation. As a general rule, the weight of the fastener installation module 16' should be minimized because the standard industrial robot 14' (not shown) has a relatively low load capacity.

Figure 13:
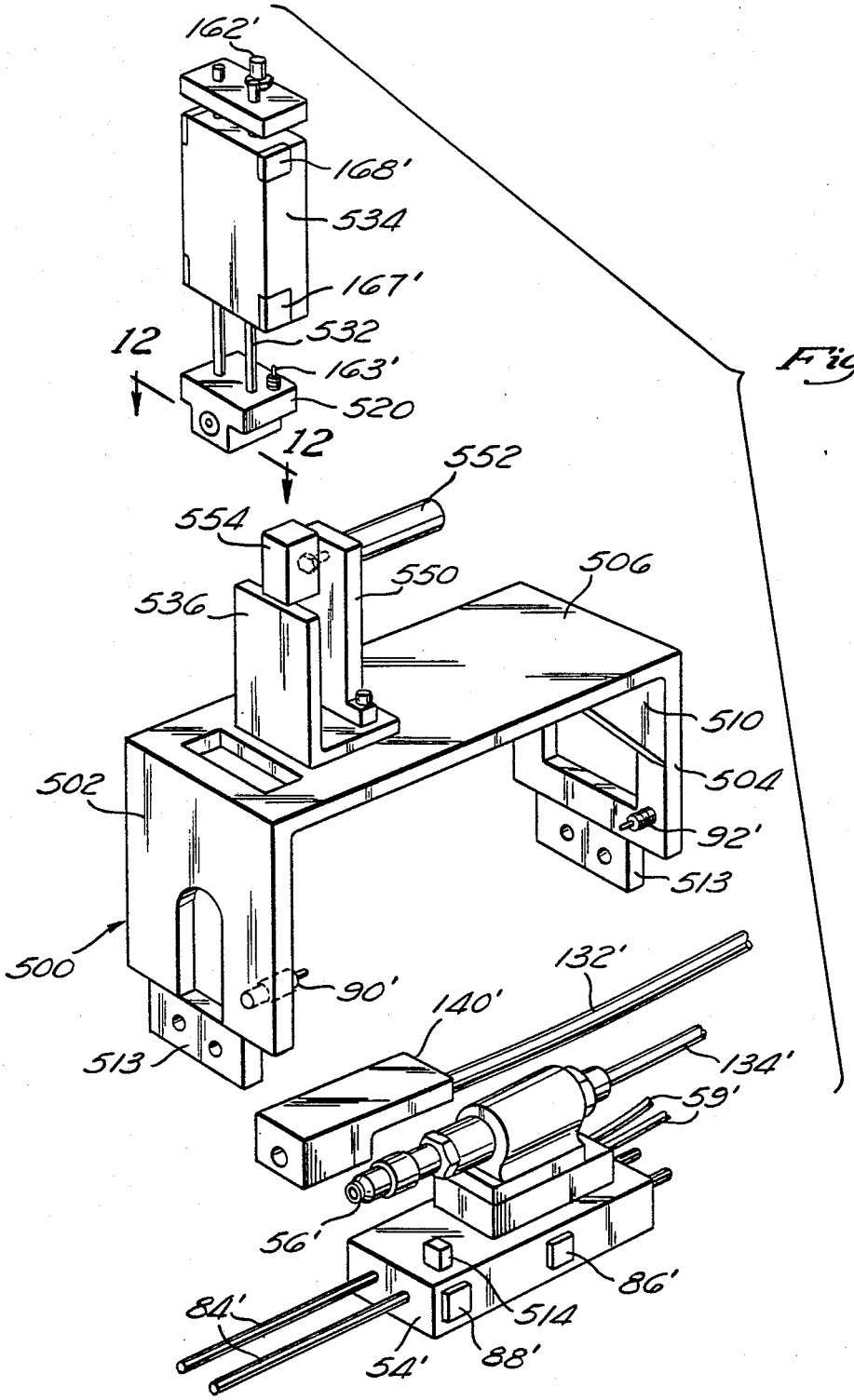
FIG. 13 is an exploded perspective view of the apparatus of FIG. 10.

Referring to FIGS. 10 and 13, in order to minimize the length and weight of the fastener installation module 16', the module is built around frame 500, which is U-shaped in cross section. The downwardly extending legs 502, 504 may be rigidly attached to the base plate 506, for example, using gussets 510. The frame 500 and associated stiffening means 510 may be fastened by any number of suitable means, such as threaded fasteners, dowels or welding.

Spanning the bottom ends of frame legs 502, 504 is the main slide assembly 512. This slide assembly 512 is similar to, if not identical, to that employed in the preferred embodiment. The depending frame legs 502, 504 have attached thereto tie plates 513, which are spanned by guide rods 84'. Reciprocally mounted on guide rods 84' is slide 54', which is arranged to reciprocate on guide rods 84' by means of pneumatic pressure. The slide 54' has clearance and rear proximity switches 86', 88'. As in the preferred embodiment, these proximity switches 86', 88', indicate when the slide 54' is in its mid position and most rearward position, respectively.

The rate of speed and deceleration of the slide 54' proximate the forward and rearward positions is affected by forward and rearward dampeners 90', 92'. As discussed in conjunction with the preferred embodiment, these dampeners 90', 92' may be standard pneumatic shock absorbers. The dampeners 90', 92' are preferably mounted directly onto depending frame legs 502, 504. The proximity switches 86', 88' are preferably mounted onto the slide 54' in associated mounting holes provided by the manufacturer. As shown in FIG. 10, the dampeners 90', 92' may be actuated by the slide 54' itself, or a stop block 514 attached thereto. Use of a hardened stop block 514 reduces wear on the slide 54'.

Mounted on the top of the reciprocating slide 54' is the manifold 58'. The manifold 58' receives pressurized air and pressurized hydraulic fluid for introduction into the pulling head 44' through hoses 59'. Mounted on top of the manifold 58' is the pulling head 44'.

The pulling head 44' may be conveniently arranged identically to that of the preferred embodiment. Referring to FIG. 9, the pulling head 44' has a nosepiece 50 with a central nosepiece aperture 46. Disposed within the pulling head 44' are a set of expandable jaws 52 having an inclined surface 126 adapted for cooperation with compression collet 130. The hydraulic fluid introduced through the manifold 58' operates a hydraulic piston (not shown) which is normally biased forward and upon actuation draws the compression collet 130 rearward. This rearward travel of compression collet 130 causes cooperation at inclined surface 126 to urge jaws 52 radially inward and rearward. The pulling head 44' may be conveniently provided with the spring loaded collar 56 mounted on a sleeve 110. The collar 56 is urged forward, along with the arm 112 and the proximity target 122, by spring 114, which in turn urges the spring retainer 116 against the sleeve shoulder 118. Thus, a proximity detector 124 may be utilized in conjunction with the spring loaded collar 56 to provide an indication when the pulling head nosepiece 50 is urged against the workpiece 55. As shown in FIGS. 10–11, 13 attached to the rear of the pulling head 44' is a fastener stem ejection tube 134'.

Instead of the rotary pick and place arm 34 of the preferred embodiment, the alternate embodiment has a linearly reciprocal pick and place slide block 520. Referring to FIG. 12, the pick and place slide block 520 has an orifice 144' for receiving the fastener head 66' and sleeve 68'. This orifice 144' extends rearward from the pick and place block face 150'. At the rear of the pick and place block orifice 144' is the fastener stem stop 152'. Use of a separate stop 152' allows use of material which is significantly harder than the conventional screw shown in conjunction with the preferred embodiment. Hardening the stop 152' results in increased durability and life and an attendant decrease in maintenance expense. Instead of the adjustable screw provided in the preferred embodiment, a threaded plug 522 may be used to secure hardened stop 152'. To prevent the escape of pneumatic pressure or introduction of ambient pressure to a vacuum from around the edges of the stop insert 522, a suitable seal 524, such as the 0-ring shown, may be provided. Insert 522 may be provided with means for facilitating its insertion and removal, such as the hex recess 525 shown.

Providing fluid connection from the pick and place block orifice 144' to the vacuum pump 36', is a pump hose 146'. Pump hose 146' is connected, via suitable fittings (not shown), to a fluid path intersecting orifice 144'. The pick and place block orifice 144' may be contained within a removable insert 526. The insert 526 and the pick and place block 520 may be sealed from escape of pneumatic pressure and introduction of ambient pressure to a vacuum by providing a front seal 530, such as the 0-ring shown. Suitable means for removing the insert 526 may be provided, such as the holes 531 for a spanner wrench.

Referring to FIGS. 10–11, 13, the pick and place block 520 is attached to the end of pick and place guide rods 532. The guide rods 532 are adapted to reciprocate within pick and place slide 534. The pick and place slide 534 is mounted to a bracket 536, which is in turn mounted to the frame base plate 506. Because the pick and place slide 534 is secured via bracket 536 to the base plate 506, application of pneumatic pressure to the pick and place slide 534 causes reciprocation of the guide rods 532 and the associated pick and place block 520. The up and down travel of the pick and place slide 534 is in part controlled by top and bottom dampeners 162', 163'. These dampeners 162', 163' may conveniently be identical to those limiting the travel of the main slide 54', dampeners 90', 92'.

The location of the pick and place guide rods 532 with respect to the slide 534 is indicated by the top and bottom proximity detectors 167', 168'. These proximity detectors, like those 86', 88' on the main slide 54', are conveniently provided by the slide manufacturer and may be attached directly to the slide 534.

The lowermost position of pick and place slide 534 places the pick and place block 520 into alignment with the pulling head 44', as shown in FIG. 11. That is, the pick and place block orifice 144' has its central axis aligned with the central axis of nosepiece aperture 46'. This allows transfer of a fastener 13' between the pick and place block 520 and pulling head 44'.

In the uppermost position of pick and place slide 534, shown in phantom in FIG. 11, the pick and place block 520 is aligned with the fastener presentment tube 140', to which is attached the fastener feed tube 32'. Thus, the fastener feed tube 32' delivers a fastener 13' to the fastener presentment tube 140' and the pick and place block 520, and pick and place slide 534 then moves the pick and place block 520 and its associated fastener 13' into alignment with the pulling head 44'.

Shown mounted on pick and place slide bracket 536 is intermediate stop block mounting bracket 550, which supports a pneumatic cylinder 552. This pneumatic cylinder 552 linearly positions the intermediate stop block 554. Extension of the pneumatic cylinder 552 places the intermediate stop block 554 between the pick and place slide mounting bracket 536 and the tie plate 556, thereby inhibiting further downward travel of pick and place guide rods 532 and their associated pick and place block 520. Actuation of the pick and place slide 534 and pneumatic cylinder 552 causes the pick and place block 520 to be positioned in an intermediate position (not shown), between the pulling head 44' and the fastener presentment tube 140'. This intermediate position allows clearing of the pick and place block 520 by expulsion of the fastener 13' into an area unobstructed either by the fastener presentment tube 140' or pulling head 44'. This feature is important in that expulsion of a fastener 13' from the pick and place block 520 into the pulling head 44' may damage the collar 56' or jam the nosepiece aperture 46'. Likewise, expulsion of a fastener 13 from the pick and place block 520 into the fastener presentment tube 140' may cause its jamming and obstruction. Expulsion of the fastener 13' from the pick and place block 520, in the intermediate position, allows the fastener 13' to be expelled into the collection tray 560 mounted on the bottom of the fastener installation module 16' unobstructed by the fastener presentment tube 140' or the pulling head 44'.

It will be understood by one of ordinary skill in the art that the structure of the alternate embodiment disclosed herein may be operated in a manner identical to that of the preferred embodiment disclosed above. Further, the alternate embodiment may be configured in any suitable orientation, for instance, having the base plate 506 below or at other angles to the pulling head 44'. Similarly, the pick and place arm 34 or block 520 may be oriented in many suitable planes. For instance, the rotatable pick and place arm 34 of the preferred embodiment may be oriented in relation to the pulling head 44 at any angle in a plane perpendicular to the nosepiece aperture 46 or in any other plane with respect thereto. Additionally, the particular configuration of the workpiece or other factors may dictate other combinations of slide construction, pick and place movements, and components arranged therein to facilitate structural clearance and compliance with accessibility restrictions of the workpiece 55.

This invention has been described in detail in connection with the preferred embodiments, but these are examples only and this invention is not restricted thereto. It will be understood by those skilled in their art that other variations and modifications can be easily made within the scope of this invention.

What is claimed is:

1. Apparatus for automatically installing a fastener in a workpiece comprising:

a base adapted to be mounted on a robot used to move said fastener installing apparatus to locations for installing fasteners in said workpiece;

a pulling head movable relative to said base towards and away form said workpiece, said head having a chamber for receiving a fastener and having means for applying a pulling force on the fastener stem to set the fastener in the workpiece and breaking away a portion of said stem as the fastener is set in said workpiece; and said detector in response to said event being adapted to provide an output utilized to interrupt the stem pulling force and to initiate the withdrawal of said head.

2. The apparatus of claim 1 including a sensor for sensing the withdrawal of said head to a point where it will clear the workpiece and for providing a signal to said robot indicating that the robot can move safely to its next position.

3. The apparatus of claim 2 including a sensor responsive to the withdrawal of said head for initiating the transfer of another fastener to said pulling head.

4. The apparatus of claim 1 wherein said head reciprocates linearly, and including means for transferring a fastener transversely in a plane perpendicular to the head movement into axial alignment with said chamber.

5. The apparatus of claim 4 wherein said transfer means comprises an arm pivotally mounted on said base into and out of positions wherein an orifice in said arm is axially aligned with said chamber.

6. The apparatus of claim 4 wherein said transfer means comprises a fastener carrier mounted on said base for reciprocating linear transverse movement into and out of alignment with said chamber.

7. The apparatus of claim 6 wherein said pulling head includes means for detecting when a fastener has been inserted sufficiently far into said workpiece and for initiating a pulling force on said fasteners stem.

8. The apparatus of claim 7 wherein said detecting means comprises an element carried by said head which is movably mounted to engage said workpiece and which cooperates with a sensor to initiate a pulling force on said stem.

9. Apparatus for automatically installing a fastener in a workpiece comprising:

a fastener installing device adapted to be mounted on a robot;

a control module for receiving a signal from the robot to commence a fastener installing cycle and for instructing the robot not to move said device until the cycle is complete;

means on said device for sensing the installing of a fastener and to initiate movement of said robot to a next position;

a fastener transfer device for receiving fasteners from a feeder and for transferring fasteners to said installation device;

means on said installation device to sense the absence of a fastener in said installation device and to initiate transfer of a fastener from said transfer device to said installation device even though the apparatus may be being moved to a new fastener installing position by said robot; and feed means for feeding fasteners to said transfer device even though the apparatus may be being moved to a new fastener position by said robot.

10. The apparatus of claim 9 wherein said installing device includes a base for mounting on a robot, a support mounted for reciprocating linear movement on said base, and a pulling head mounted on said support for movement towards and away from said workpiece, the sensing means on said installing device senses the withdrawal of said head away from said workpiece to initiate movement of said robot to said next position.

11. The apparatus of claim 10 including a stop for limiting movement of said support towards said workpiece when said transfer device is transferring a fastener to said installing device.

* * * * *